US006376789B2

(12) United States Patent
Maruyama et al.

(10) Patent No.: US 6,376,789 B2
(45) Date of Patent: Apr. 23, 2002

(54) KEY SWITCH AND KEYBOARD

(75) Inventors: Junichi Maruyama; Takashi Terada; Hitoshi Ohkubo; Kazutoshi Hayashi, all of Tokyo (JP)

(73) Assignee: Fujitsu Takamisawa Component Ltd., Tokyo (JP)

( * ) Notice: Subject to any disclaimer, the term of this patent is extended or adjusted under 35 U.S.C. 154(b) by 0 days.

(21) Appl. No.: 09/833,709

(22) Filed: Apr. 13, 2001

(30) Foreign Application Priority Data

Apr. 14, 2000 (JP) ..... 2000-118553

(51) Int. Cl.[7] ..... H01H 13/70
(52) U.S. Cl. ..... 200/344; 200/5 A
(58) Field of Search ..... 200/5 A, 341, 200/344, 349, 517; 400/490, 491, 491.2, 495, 495.1, 496

(56) References Cited

U.S. PATENT DOCUMENTS 5,504,283 A * 4/1996 Kako et al. ..... 200/5 A
5,562,203 A * 10/1996 Mochizuki ..... 200/345
5,763,842 A * 6/1998 Tsai et al. ..... 200/5 A
6,091,036 A * 7/2000 Hu ..... 200/344
6,179,497 B1 * 1/2001 Hu ..... 400/495

FOREIGN PATENT DOCUMENTS

JP 5-66832 9/1993 ..... H01H/13/14
JP 9-27235 1/1997 ..... H01H/13/14
JP 11-3628 1/1999 ..... H01H/13/14

* cited by examiner

*Primary Examiner*—Michael Friedhofer
(74) *Attorney, Agent, or Firm*—Staas & Halsey LLP

(57) ABSTRACT

A key switch includes a base, a key top arranged above the base, a pair of link members interlocked to each other to support the key top above the base and direct the key top in a vertical direction, and a switching mechanism capable of opening and closing an electric circuit in connection with a vertical movement of the key top. Each of the link members includes an engagable end region engaged with the key top. The base includes an inner peripheral surface defining an opening capable of receiving the link members. The base is provided on the inner peripheral surface with protruding wall parts located at positions respectively facing oppositely to the engagable end regions of the link members. Each protruding wall part serves to locally reduce a clearance defined between the inner peripheral surface and the engagable region of each link member when the link member is received in the opening.

26 Claims, 19 Drawing Sheets

KEY SWITCH AND KEYBOARD

BACKGROUND OF THE INVENTION

1. Field of the Invention

The present invention relates generally to a switch mechanism for key-entry operation and, more particularly, to a key-entry switch (hereinafter referred to as a key switch) preferably used for a keyboard incorporated as an input device in electronic equipment. The present invention also relates to a keyboard provided with a plurality of key switches.

2. Description of the Related Art

In the technical field of portable electronic equipment such as notebook-size personal computers or wordprocessors, etc., various techniques have been proposed to facilitate a reduction in height or thickness of the housing of equipment including a keyboard and to improve the portability of the equipment. Particularly, when the height of a keyboard provided with a plurality of key switches is to be reduced, it has been generally required to maintain the stroke of each key switch at a predetermined length to ensure constant operational properties thereof and, simultaneously, to reduce the entire height of the key switch upon both the non-operated (or switched-off) and operated (or pushed-down and switched-on) conditions thereof.

A conventional key switch for use in a relatively thin keyboard with a reduced height generally includes a base, a key top disposed above the base, a pair of link members for supporting the key top above the base and directing the key top in the vertical or up-and-down direction, and a switching mechanism for selectively opening/closing contact points in an electric circuit in accordance with the vertical or up-and-down movement of the key top. The conventional pair of link members has been provided essentially with any one of three types of configurations.

First type pair of link members may be referred to as a gear-link type, wherein the link members are assembled together into a reverse V-shape as seen in a lateral direction and meshed at toothed end regions thereof with each other, each link member being slidably engaged at a first end region thereof with the base and pivotably engaged at the toothed or second end region with the key top (see, e.g., Japanese Unexamined Patent Publication (Kokai) No. 11-3628). Second type pair of link members may be referred to as a pantograph type, wherein the link members are assembled together into an X-shape as seen in a lateral direction and rotatably joined at intersections thereof with each other, each link member being slidably engaged at a first end region thereof with one of the base and the key top and pivotably engaged at a second end region with the other of the base or the key top (see, e.g., Japanese Unexamined Utility Model Publication (Kokai) No. 5-66832). Third type pair of link members may be referred to as a modified pantograph type, wherein the link members are assembled together into an X-shape as seen in a lateral direction and slidably connected at intersections thereof with each other, each link member being slidably engaged at a first end region thereof with the base and pivotably engaged at a second end region with the key top (see, e.g., Japanese Unexamined Patent Publication (Kokai) No. 9-27235).

In the conventional key switch having any one of the above types of link members, the link members are shifted in a mutually interlocked manner, and the key top is thereby allowed to be moved in a parallel displacement in a substantially vertical direction relative to the base, while keeping a predetermined posture of the key top. Once the key top reaches a lowermost position of a vertical or key-entry stroke thereof, the link members are laid in a generally horizontal position under the key top and received inside an opening defined in the base. This arrangement permits the entire height of the key switch to be reduced in both the non-operated and operated conditions while maintaining the key-entry stroke of the key top at a desired length.

In the conventional key switch having the gear-link type pair of link members as described, each link member includes a pair of arms extending generally parallel to each other and a pair of axles formed at the second end region of the link member, i.e., the distal end region of the respective arms, the axles extending outward along the rotation axis of the second end region for pivotable engagement with the key top. Each arm of the link member is further provided with one or more teeth projecting outward from the second end region in a direction generally orthogonal to the rotation axis, the teeth constituting an interlocking element for meshable engagement with the second end region of the counterpart link member.

On the other hand, the key top is provided with two pairs of pivot supports for pivotably supporting the axles of the respective arms of the respective link members. The pivot supports are formed on the inner surface of the key top as separate plate-like projections extending generally parallel to one another. Each pivot support includes a bearing hole for pivotably receiving the axle of each arm of each link member and a slit communicating with the bearing hole. The slit of the pivot support is shaped and dimensioned so as to define an opening smaller than the associated axle of the link member. The slits of four pivot supports extend generally parallel to one another and in a direction generally perpendicular to the inner surface of the key top.

In the assembling process of the abovedescribed key switch, first the link members are arranged so as to engage the first end regions thereof to the base and to mesh the corresponding teeth thereof with each other, and are laid in a generally horizontal position to be received inside the opening of the base. In this state, the link members are positioned at a location substantially identical to a location defined by the lowermost position of key-entry stroke of the key top. Then, the key top is put on the link members so as to bring the respective pivot supports into contact with the associated axles, and is pushed down on the link members. Thereby, the axles are inserted into the slits of the correlate pivot supports under pressure to elastically deform the pivot supports, and are finally press-fitted into the bearing holes in a snap-fit manner. This configuration generally facilitates both the assembling process of the key switch and the construction of a mold used for molding the key top.

In the above conventional structure of the key switch having the gear-link type pair of link members, the base and the link members are typically shaped and dimensioned so that a slight clearance may be defined between the second end region (especially, the distal end of each axle) of each link member and the inner peripheral surface at the opening of the base after the assembling process is completed, so as to ensure the relatively easy press-fitting operation in the assembling process for the respective pivot supports of the key top fitted with the associated axles of the link members. However, such a clearance tends to enable the link members located inside the base opening to be slightly displaced in a horizontal direction, which may result in an incorrect intermesh between the toothed end regions or interlocking elements of the link members located inside the base opening due to an inadvertent mutual horizontal displacement caused between the link members before the key top is fitted to the link members.

If the key top is press-fitted to the incorrectly intermeshed link members as described, problems may arise wherein the tooth or teeth of the toothed end regions of the link members are deformed or damaged, which may affect the key-entry operation or stroke properties of the key switch. Accordingly, it is typically required for the assembling process of the conventional key switch to correct the intermeshed state of the gear-link type pair of link members before the key top is fitted with the link members.

In a typical assembling process of a conventional keyboard including a plurality of key switches having the above-described structure, a large-sized base panel (referred to as, e.g., a switch panel) with a plurality of openings respectively used for the individual key switches is provided, and the plural pairs of link members are inserted into the respective openings in the intermeshed state as described and, in this state, the key tops of the individual key switches are press-fitted to the associated pairs of link members. Therefore, it is necessary to investigate the intermeshed state of the link members of all the key switches and properly correct the probable incorrectly intermeshed state thereof, before the key tops are fitted to the link members. However, such investigation and correction have generally been performed by a manual operation, and thus have required much time and the skill of an operator, which may increase the manufacturing cost of the key switches as well as of the keyboard. Also, a certain careless error in correction may arise when the investigation and correction are repeatedly performed in the assembling process of many keyboards.

Also, in a conventional key switch having any type pair of link members, i.e., the gear-link type pair, the pantograph type pair or the modified pantograph type pair, each link member is pivotably connected through the axles provided on the first or second end region of the link member with either the base or the key top. The axles of each link member are respectively fitted into the bearing holes or grooves of the associated pivot supports provided on the base or the key top. In this structure, the slit communicating with the bearing hole is typically formed in each pivot support so as to ease the press-fitting operation of the axle and simplify the construction of a mold for the key top, as already described. However, the slit may facilitate the generation of backlash of the axle in the bearing hole, which may cause problems of the fluctuation or wobble of the key top and the resultant noise during the key-entry operation. If the pivotable engagement between the axle and the bearing hole is designed to be excessively tight to solve the above problems, the key-entry operation properties may be deteriorated.

Moreover, in the conventional key switch having any type pair of link members, i.e., the gear-link type pair, the pantograph type pair or the modified pantograph type pair, the key top is continuously applied with a biasing force by an elastic member in a vertical upward direction away from the base. In the key-entry operation, the key top is pushed downward against the upward biasing force of the elastic member, whereby the electric contact points of the switching mechanism disposed beneath the key top are closed. Therefore, when a downward pushing force to the key top is released, the key top is moved back to an initial or uppermost position in the key-entry stroke by the biasing force of the elastic member under the guiding action of the link member pair. In this respect, the uppermost position of the key top is determined at the instant when the axles provided to project from the slidable end region of each link member are abutted to and stopped by the walls of the associated slide supports, slidably supporting these axles, formed on the base or the key top. Consequently, at the time when the key top reaches the uppermost position, a collision noise is generated between the axles on the slidable end region of each link member and the walls of the associated slide supports on the base or the key top. It is desired to reduce this type of collision noise generated between some components in the key switch as much as possible, in consideration of the use of the keyboard in situations demanding quietness.

Incidentally, in the assembling process of the conventional keyboard, the key top of each key switch is often printed with desired one or more signs, such as letters or symbols, after the key tops of all the key switches are fitted to the associated link member pairs. In the case where the key switches incorporated in the keyboard include the key tops having various shapes and/or colors, it is necessary to manage the stock of the various types of precursor or non-printed key tops according to the shapes and/or colors thereof, preparing for the assembling process of the keyboard, and to supply the precursor key tops to assembling lines while identifying the required shapes and/or colors thereof. Moreover, in the case where the key tops formed from various materials should be stored, for the purpose of, e.g., allowing respective key tops to be subjected to different printing steps such as laser printing, pad printing, and so on, it is necessary to manage the stock of the precursor key tops according to the materials thereof in addition to the shapes and/or colors. However, it is ordinarily difficult to visually identify the key tops having different materials but identical shapes and colors. If the key tops having different materials but identical shapes and colors are accidentally or carelessly mixed in a storage and/or supply stage, the assembling process of the keyboard may suffer due to, e.g., a poor printing step wherein the key top made of a material suitable for pad printing is subjected to laser printing.

SUMMARY OF THE INVENTION

It is therefore an object of the present invention to provide a key switch including a key top adaptable for a key-entry operation, in which, in an assembling process, a gear-link type pair of link members can be relatively easily set in an accurate intermeshed state and the possibility of inaccurate intermeshing can be reduced or eliminated, before the key top is fitted with the link members, so that the assembling process of the key switch and of a keyboard can be simplified and the manufacturing cost thereof can be reduced.

It is another object of the present invention to provide a key switch including a key top adaptable for a key-entry operation, in which the backlash in a pair of link members generated due to a clearance defined between certain components constituting pivotable joints of the link members to a base or the key top can be restrained, without deteriorating key-entry operation properties, so that the fluctuation or wobble of the key top and the resultant noise, which may be generated during the key-entry operation, can be reduced or eliminated.

It is yet another object of the present invention to provide a key switch including a key top adaptable for a key-entry operation, in which, in the key-entry operation of the key top, a collision noise, generated between certain components at the instant when the key top reaches an initial uppermost position in a key-entry stroke, can be reduced or eliminated.

It is a further object of the present invention to provide a key switch including a key top adaptable for a key-entry operation, which can make it possible to precisely and relatively easily identify various key tops made of different materials, so that the productivity of a keyboard incorporating therein a plurality of key switches can be improved.

It is an yet further object of the present invention to provide a keyboard incorporating therein a plurality of key switches, which can provide good assembling properties and superior operability of key switches.

In accordance with the present invention, there is provided a key switch comprising a base; a key top arranged above the base; a pair of link members interlocked with each other to support the key top above the base and direct the key top in a vertical direction, each of the link members including an engagable region engaged with the key top; and a switching mechanism capable of opening and closing an electric circuit in connection with a vertical movement of the key top; wherein the base is provided with an inner peripheral surface defining an opening capable of receiving the pair of link members, and a protruding wall part provided on the inner peripheral surface to locally reduce a clearance defined between the inner peripheral surface and the engagable region of each of the link members when the link members are received in the opening.

In one aspect of the invention, each of the link members may be provided at the engagable region with an axle projecting outward, the axle being pivotably connected with the key top, and the base may be provided with a plurality of protruding wall parts on the inner peripheral surface, each of the protruding wall parts being positioned so as to oppositely and closely face the axle of each link member when the key top is located at a lowermost position of a key-entry stroke.

In this arrangement, each of the protruding wall parts may have a cross-sectional shape smaller than that of the axle of associated one of the link members.

It is preferred that the protruding wall part has a uniform height measured from the inner peripheral surface.

It is also preferred that the protruding wall part has a gradually increased height measured from the inner peripheral surface as seen in a direction away from the key top.

The present invention also provides a key switch comprising: a base; a key top arranged above the base; a pair of link members interlocked to each other to support the key top above the base and direct the key top in a vertical direction, each of the link members including an engagable region engaged with one of the base and the key top; and a switching mechanism capable of opening and closing an electric circuit in connection with a vertical movement of the key top; wherein each of the link members is locally abutted in the engagable region onto one of the base and the key top under an elastic restoring force generated relatively in each link member and the base or the key top with which the link member is engaged.

In one aspect of the invention, the key top may be provided with pivot supports and abutting plates arranged respectively adjacent to the pivot supports, each of the link members may be provided at the engagable region with an axle projecting outward, the axle being pivotably connected with one of the pivot supports of the key top, and the axle may be provided with an end surface including an apex abutted to one of the abutting plates arranged adjacent to one of the pivot supports with which the axle is pivotably connected.

In this arrangement, the axle may be abutted at the apex to one of the abutting plates under a certain pressure caused due to an elastic restoring force generated relatively in one of the link members and an associated one of the abutting plates.

In another aspect of the invention, the base may be provided with slide supports, each of the link members may be provided at the engagable region with an axle projecting outward, the axle being slidably connected with one of the slide supports of the base, and the axle may be provided with an end surface including an apex abutted to one of the slide supports with which the axle is slidably connected.

In a yet another aspect of the invention, the base may be provided with slide supports, each of the link members may be provided at the engagable region with an axle projecting outward, the axle being slidably connected with one of the slide supports of the base, and the axle may be provided with an annular rib circumferentially extending along a part of an axial length of the axle, the annular rib being abutted to one of the slide supports with which the axle is slidably connected.

In a further aspect of the invention, the key top may be provided with pivot supports, each of the link members may be provided at the engagable region with an axle projecting outward, the axle being pivotably connected with one of the pivot supports of the key top, and each of the link members may be provided with a textured surface located around a proximal end of the axle, the textured surface being abutted to one of the pivot supports with which the axle is pivotably connected.

In a yet further aspect of the invention, the key top may be provided with pivot supports, each of the link members may be provided at the engagable region with an axle projecting outward, the axle being pivotably connected with one of the pivot supports of the key top, and each of the link members may be provided with a protuberance located adjacent to a proximal end of the axle, the protuberance being abutted to one of the pivot supports with which the axle is pivotably connected.

The present invention also provides a key switch comprising a base; a key top arranged above the base; a pair of link members interlocked to each other to support the key top above the base and direct the key top in a vertical direction, each of the link members including an engagable region slidably engaged with one of the base and the key top; a switching mechanism capable of opening and closing an electric circuit in connection with a vertical movement of the key top; and a buffering portion for gradually braking a sliding motion of the engagable region of each of the link members relative to one of the base and the key top caused in accordance with the vertical movement of the key top just before the key top reaches an uppermost position of a key-entry stroke.

In one aspect of the invention, the buffering portion may comprise a buffer plate extending from the base, the buffer plate being elastically deflected by one of the link members colliding with the buffer plate just before the key top reaches the uppermost position.

In another aspect of the invention, the buffering portion may comprise a slanted wall surface formed on the base to face the engagable region of one of the link members, the slanted wall surface exerting a contact pressure against one of the link members colliding with the slanted wall surface just before the key top reaches the uppermost position.

In a further aspect of the invention, the key switch may further comprise a sheet member arranged beneath the base, and the buffering portion may comprise a high-friction area formed on the sheet member, the high-friction area exerting a friction force against one of the link members running onto the high-friction area just before the key top reaches the uppermost position.

The present invention also provides a key switch comprising a key top having an operating surface for a key-entry operation and supported to be directed in a vertical direction above a base; the key top being provided with an identifying portion for identification of an attribute of the key top.

In one aspect of the invention, the identifying portion may comprise a plurality of elements having various features including at least one of numbers, locations, shapes and dimensions.

In this arrangement, the key top may further include a brim surface adjacent to the operating surface, and the elements may be formed as recesses on the brim surface.

The present invention also provides a keyboard comprising a plurality of key switches, each of the key switches having any one of the above-described features.

BRIEF DESCRIPTION OF THE DRAWINGS

The above and other objects, features and advantages of the present invention will become more apparent from the following description of preferred embodiments in connection with the accompanying drawings, in which.

DESCRIPTION OF THE PREFERRED EMBODIMENT

Figure 1:
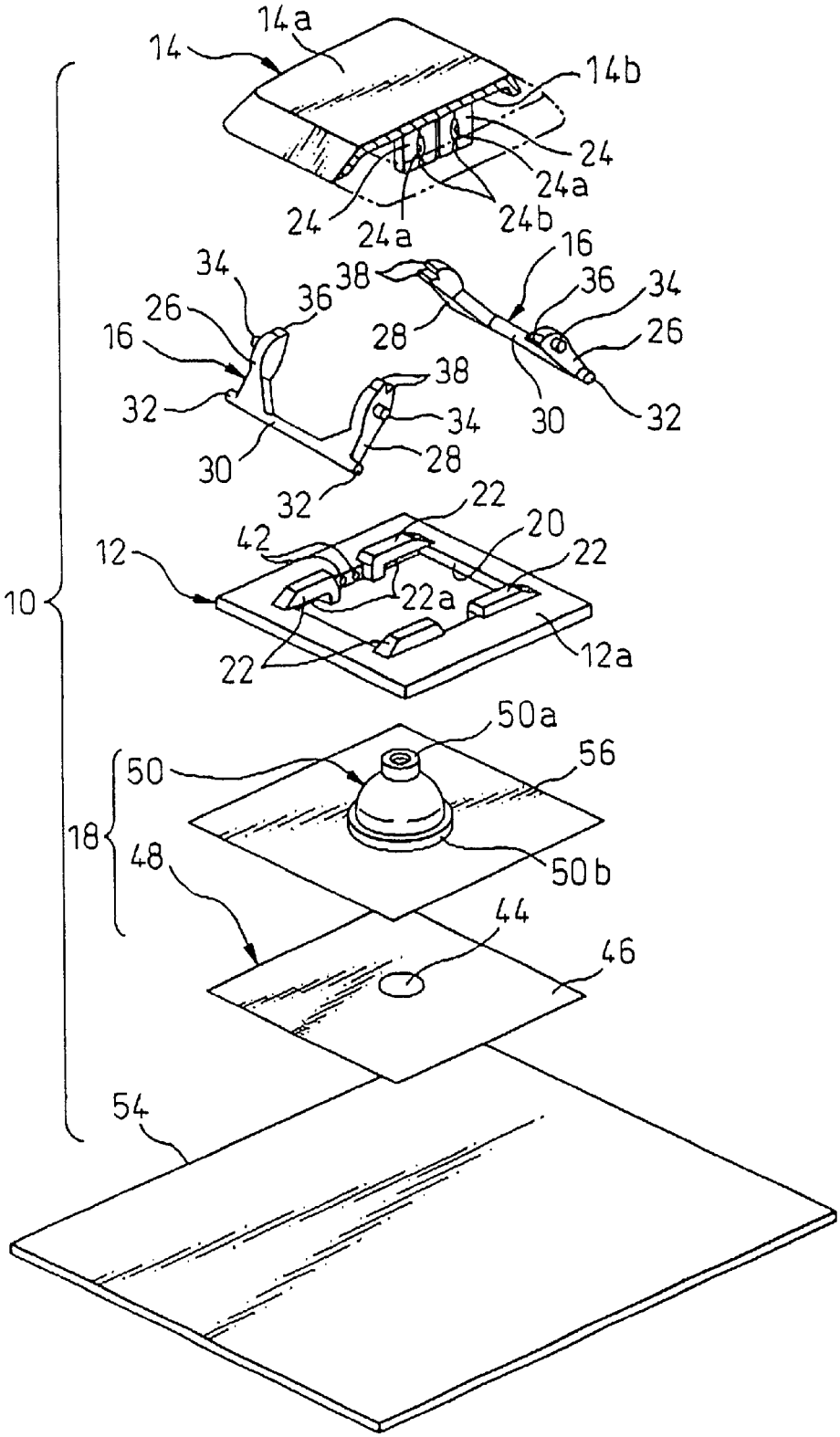
FIG. 1 is an exploded perspective view showing a key switch according to a first embodiment of the present invention.
Figure 2:
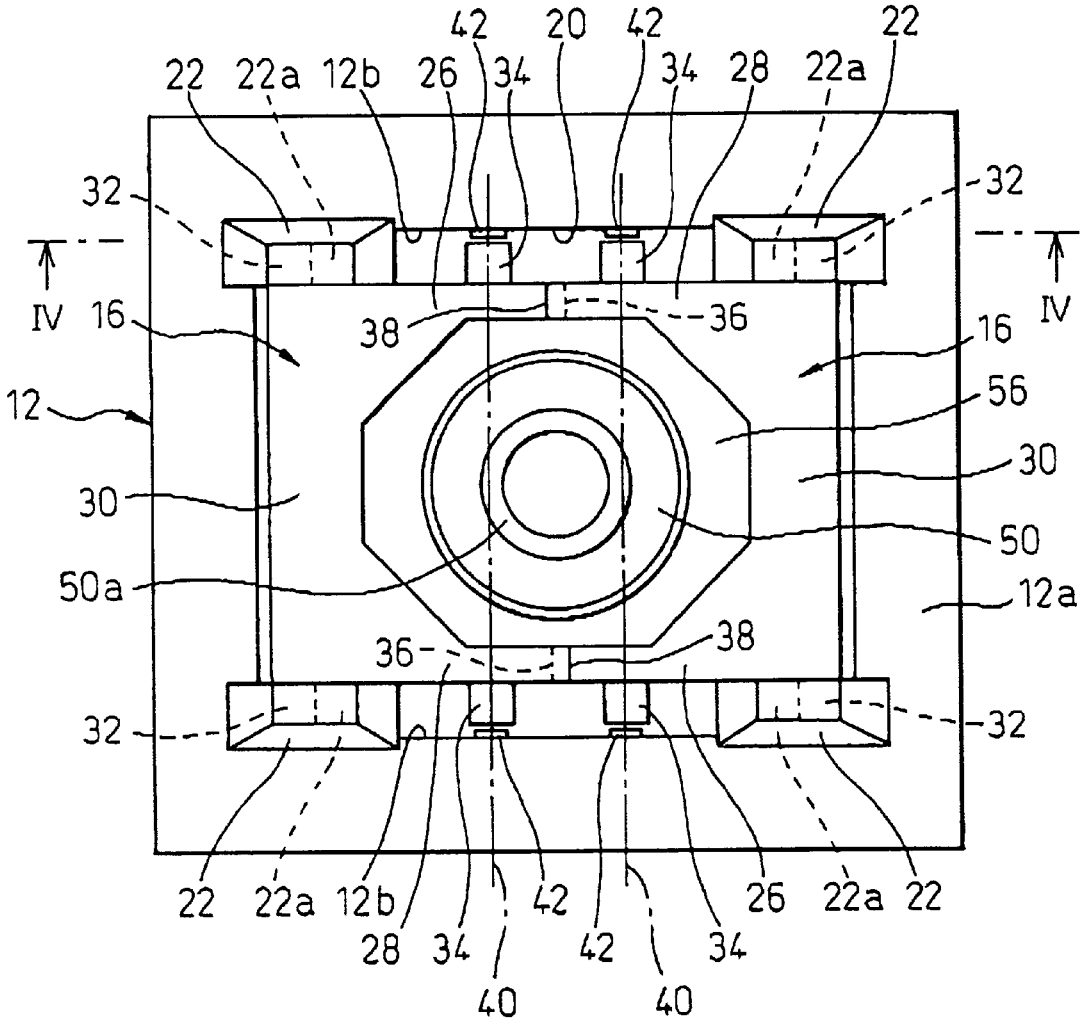
FIG. 2 is a top plan view of the key switch of FIG. 1 in a partially assembled state before a key top is fitted.
Figure 3:
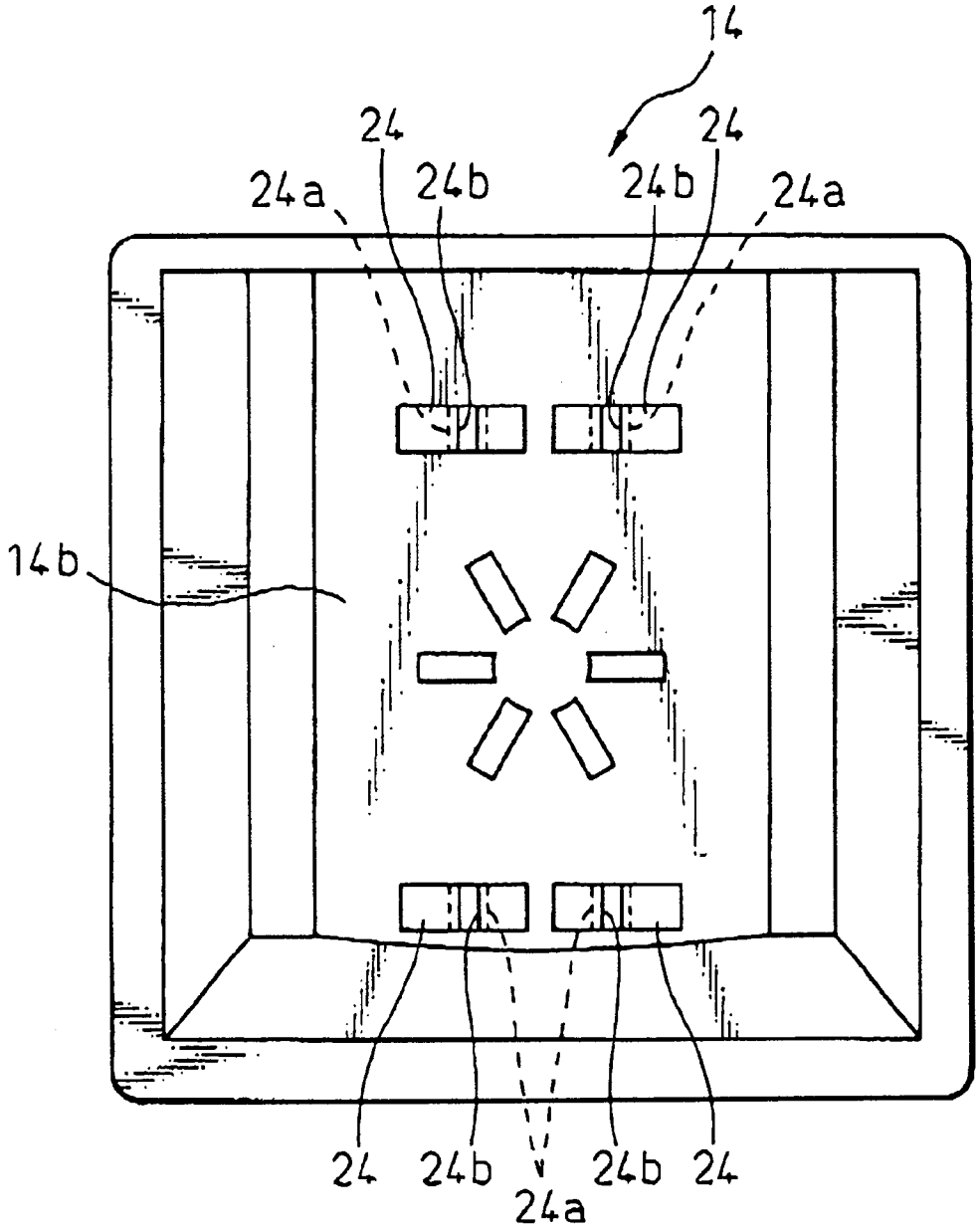
FIG. 3 is a bottom view of a key top used in the key switch of FIG. 1.

Referring now to the drawings, in which the same or similar components are denoted by common reference numerals, FIG. 1 is an exploded perspective view showing a key switch 10 according to a first embodiment of the present invention, FIG. 2 is a top plan view of the key switch 10 shown in a partially assembled state before a key top is fitted, and FIG. 3 is a bottom view of a key top used in the key switch 10. The key switch 10 includes a base 12, a key top 14 disposed movably in a vertical or up-and-down direction on a major surface 12*a* of the base 12, a pair of link members 16 for supporting the key top 14 above the base 12 and directing or guiding the key top 14 in the vertical direction, and a switching mechanism 18 capable of opening and closing contact points of an electric circuit in accordance with the vertical movement of the key top 14.

The base 12 is a frame-like member having a generally rectangular center opening 20 arranged to be covered by the key top 14. The base 12 is provided, along a pair of opposed inner peripheral surfaces 12*b* thereof defining the center opening 20, with two pairs of slide supports 22, one pair being spaced from the other pair in a link-slide direction as described later (i.e., leftward and rightward directions in FIG. 2). Each of the slide supports 22 includes a wall portion extending in an L-shape and projecting from the major surface 12*a* and the inner peripheral surface 12*b* of the base 12, and a guide groove 22*a* formed inside the wall portion and extending generally parallel to the major surface 12*a*.

The slide supports 22 in each pair are positioned on the opposed inner surfaces 12*b* of the base 12 in such a manner that the guide grooves 22*a* of respective slide supports 22 are disposed at locations corresponding to each other. Further, the slide supports 22 in two pairs, disposed on the respective same sides, are aligned with each other in the link-slide direction along the corresponding inner peripheral surfaces 12*b* of the base 12. Each slide support 22 slidably supports a first end region of each link member 16, as described later.

The key top 14 is a dish-like member having a generally rectangular profile, and has an operating surface 14*a* adapted to be pressed by an operator's finger. The key top 14 is provided, on an inner surface 14*b* thereof opposite to the operating surface 14*a*, with two pairs of pivot supports 24, one pair being spaced from the other pair in the link-slide direction (i.e., leftward and rightward directions in FIG. 3). Each of the pivot supports 24 is formed as a small plate uprightly projecting from the inner surface 14*b* of the key top 14, and includes a bearing hole 24*a* penetrating through the thickness of the plate and a slit 24*b* extending generally perpendicularly to the inner surface 14*b* to communicate with the bearing hole 24*a*.

The pivot supports 24 in each pair are positioned on the inner surface 14*b* of the key top 14, in such a manner that the pivot supports 24 are spaced from each other at a distance allowing the end regions of arms 26, 28 of each link member 16 to be interposed therebetween as described later, and that the bearing holes 24*a* of respective pivot supports 24 are axially aligned with each other. Further, the pivot supports 24 in two pairs, disposed on the respective same sides, are aligned with each other in the link-slide direction on the inner surface 14*b* of the key top 14. Each pivot support 24 pivotably supports a second end region of each link member 16, as described later.

The link members 16 have shapes and dimensions substantially identical to each other. The link members 16 are assembled together into a reverse V-shape as seen in a lateral direction and meshed at toothed end regions thereof with each other, to form a gear-link type pair. Each of the link members 16 is slidably engaged or connected at a first, engagable end region thereof with the base 12 and pivotably engaged or connected at the toothed or second, engagable end region with the key top 14.

Each link member 16 includes a pair of arms 26, 28 extending generally parallel to each other and a connecting portion 30 integrally connecting the arms 26, 28 with each other. In the illustrated embodiment, the first end region of the link member 16 includes the connecting portion 30 and the thicker proximal end areas of the arms 26, 28 adjacent to the connecting portion 30, while the second end region includes the thinner distal end or parallel-length areas of the arms 26, 28 opposite to the proximal end areas.

A pair of axles 32 are formed in the first end region of each link member 16 in such a manner that the respective axles 32 mutually coaxially project on the opposite sides of the link member 16 and face away from the connecting portion 30. Also, a pair of axles 34 are formed in the second end region of each link member 16 in such a manner that the respective axles 34 mutually coaxially project on the opposite sides of the link member 16 or arms 26, 28 and extend parallel to the respective axles 32 in the same directions as the latter. Further, in the second end region of each link member 16, a single tooth 36 is formed on the first arm 26 near the axle 34 so as to project outward from the distal end face of the arm 26, while double teeth 38 are formed on the second arm 28 near the axle 34 so as to project outward from the distal end face of the arm 28.

The axles 32 formed in the first end region of the link member 16 are slidably fitted or received in the respective guide grooves 22*a* of the associated slide supports 22 on the base 12, and the axles 34 formed in the second end region of the link member 16 are pivotably fitted or received in the respective bearing holes 24*a* of the associated pivot supports 24 on the key top 14, whereby each link member 16 is arranged between the base 12 and the key top 14 in such a manner as to be pivotable about the axles 34. In this situation, the link members 16 are joined with each other through an interlocking structure wherein the single tooth 36 of the first arm 26 of each link member 16 is meshed with the double teeth 38 of the second arm 28 of the counterpart link member 16. As a result, the link members 16 can rotate about pivot axes 40 defined by respective pairs of axles 34 on the arms 26, 28 in a mutually interlocked manner.

Thus, when the link members 16 synchronously rotate about respective pivot axes 40 in opposite direction and the axles 32 of the link members 16 slide horizontally along the base 12, the key top 14 is subjected to a parallel displacement in a substantially vertical direction relative to the base 12, while keeping a predetermined, generally horizontal posture of the key top 14 wherein the operating surface 14*a* is substantially parallel to the major surface 12*a* of the base 12. The uppermost or initial position of key top 14 in a vertical or key-entry stroke thereof is determined at the instant when the interlocked sliding motion of the axles 32 of the respective link members 16 toward each other is stopped by the walls of the associated slide supports 22 defining the guide grooves 22*a* formed on the base 12. As the key top 14 moves downward from this uppermost position, the axles 32 of the respective link members 16 slidingly move away from each other in a direction generally perpendicular to the vertical direction. Once the key top 14 reaches a lowermost position of the key-entry stroke, the link members 16 are housed inside the inner surface 14*b* of the key top 14, and at least partially received in the center opening 20 of the base 12 (FIG. 2).

Figure 4:
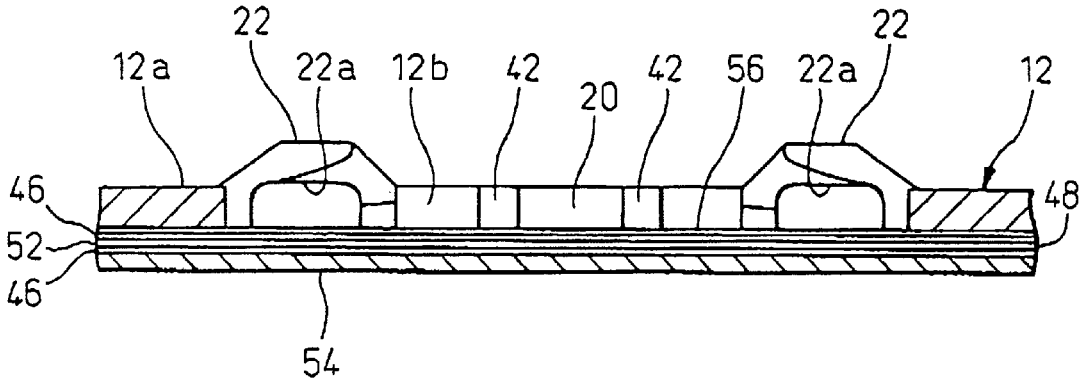
FIG. 4 is a vertical sectional view taken along line IV—IV of FIG. 2.

As shown in FIGS. 2 and 4, the base 12 is provided, on the opposed inner peripheral surfaces 12*b* defining the center opening 20, with two pairs of protruding wall parts 42 locally projecting from the inner surfaces 12*b* into the center opening 20 with each pair being arranged on each inner surface 12*b*. The protruding wall parts 42 are positioned and dimensioned so as to oppositely and closely face the axial end surfaces of the axles 34 formed in the second end regions of the respective link members 16, at the time when the key top 14 is located at the lowermost position of the key-entry stroke and the link members 16 are received in the center opening 20 of the base 12. Thus, a clearance defined between each inner surface 12*b* of the base 12, defining the center opening 20, and the axle 34 on each arm 26, 28 of each link member 16, opposing the inner surface, is locally reduced at the position of each protruding wall part 42, during the time when the link members 16 are received in the center opening 20 of the base 12.

The switching mechanism 18 of the key switch 10 comprises a sheet-like switch 48 (hereinafter referred to as a membrane switch 48) having a pair of sheet substrate 46 respectively carrying contacts 44 (only one contact 44 is shown in FIG. 1) to oppositely face the latter to each other, and an actuating member 50 disposed between the key top 14 and the membrane switch 48, which operates to close the contacts 44 as the key top 14 moves downward. A spacer 52 (FIG. 4) is interposed between the sheet substrates 46 of the membrane switch 48 so as to define a predetermined distance between the sheet substrates 46 and maintain the contacts 44 in an open state.

The sheet substrates 46 of the membrane switch 48 have well-known construction of flexible printed circuit boards, and the contacts 44 capable of contacting with each other are provided on the surface of the film substrates of the circuit boards. The sheet substrates 46 are supported beneath the base 12 on a supporting plate 54, and the contacts 44 are positioned generally centrally in the center opening 20 of the base 12. The actuating member 50 is a dome-shaped elastic member integrally formed from a rubber material, and is arranged in the center opening 20 of the base 12 with the dome top 50*a* of the actuating member being oriented toward the key top 14. When no force is applied, the dome top 50*a* of the actuating member 50 is spaced upward from the upper sheet substrate 46. The actuating member 50 is provided on the inner surface of the dome top 50*a* with a column-shaped pusher (not shown) extending toward the sheet substrates 46.

The contacts 44 carried on the sheet substrates 46 are normally held open by the inherent stiffness of each sheet substrate 46 via the spacer 52, and positioned beneath the pusher of the actuating member 50. When the external force is applied on the dome top 50*a* of the actuating member 50 in a direction toward the sheet substrates 46, the actuating member 50 is elastically deformed, and the pusher thereof presses the upper sheet substrate 46 from the outside thereof, so as to close the contacts 44. In the illustrated embodiment, the actuating member 50 is fixedly connected at the dome bottom open-end 50*b* thereof with a flexible sheet member 56 disposed between the base 12 and the upper sheet substrate 46. Alternatively, without using the sheet member 56, the actuating member 50 may be directly connected with the upper sheet substrate 46.

When no external force is applied to the key top 14 in the key switch 10, the actuating member 50 of the switching mechanism 18 urges or biases the key top 14 and supports, on the outer surface of the dome top 50*a*, the key top 14 in the uppermost position spaced vertically away from the base 12. During this condition, the membrane switch 48 is in a state where the contacts 44 are open. When the key top 14 is pushed down by a key-entry operation, the actuating member 50 is deformed while exerting an upward elastic biasing force to the key top 14, and presses the upper sheet substrate 46 from the out side thereof, just before the key top 14 reaches the lowermost position, so as to close the contacts 44. When the pushing-down force to the key top 14 is released, the actuating member 50 elastically recovers the initial shape to return the key top 14 to the initial uppermost position, and thereby the upper sheet substrate 46 restores the original shape to open the contacts 44.

In the assembling process of the key switch 10 having the above-described structure, the membrane switch 48, the actuating member 50 and the base 12 are first laid or placed on the support plate 54 in the above-described positional correlation. Then, the link members 16 are arranged so as to engage the axles 32 in the first end regions thereof to the associated slide supports 22 of the base 12 and to mesh the tooth 36 and the teeth 38 in the second end regions thereof with the counterpart tooth and teeth, and are laid in a generally horizontal position to be received inside the center opening 20 of the base 12 (FIG. 2). In this state, the axles 34 in the second end region of each link member 16 closely and oppositely face, at the axial end surfaces thereof, to the protruding wall parts 42 provided on the respective inner peripheral surfaces 12*b* of the base 12. During this condition, where the link members 16 are located at a position corresponding to the lowermost position of the key-entry stroke of the key top 14, the key top 14 is put on the link members 16 so as to bring the respective pivot supports 24 into contact with the associated axles 34, and is pushed down on the link members 16. Thereby, the axles 34 are inserted into the slits 24*b* of the associated pivot supports 24 under pressure to elastically deform the pivot supports 24, and are finally press-fitted into the bearing holes 24*a* in a snap-fit manner.

In the key switch 10, the clearance defined between the axle 34 on each arm 26, 28 of each link member 16, laid in a generally horizontal position in the center opening 20 of the base 12, and each inner surface 12*b* of the base 12, opposing the axle 34, is locally reduced at the position of each protruding wall part 42, as already described. Accordingly, if the tooth 36 and the teeth 38 of the link members 16, as interlocking elements, are incorrectly intermeshed with each other, the protruding wall parts 42 interfere with the horizontal positioning of the link members 16 in the center opening 20 of the base 12. On the other hand, once the link members 16 are laid in the horizontal position it the center opening 20 of the base 12, the link members 16 are restricted in the center opening 20 so as to be hardly displaced in the axial direction of the axles 34. As a result, the tooth 36 and the teeth 38 of the link members 16 are maintained in a correctly intermeshed state.

Moreover, each protruding wall part 42 is shaped or configured to oppositely face each axle 34 of each link member 16 in a local manner on each inner surface 12*b* of the base 12, so that the wall part 42 is prevented from being an obstacle to each pivot support 24 of the key top 14 when the pivot support 24 is pushed down on the associated axle 34. Accordingly, the relatively easy press-fitting operation for fitting the respective pivot supports 24 of the key top 14 with the associated axles 34 of the link members 16 can be obtained, to a certain extent similar to the conventional structure having no protruding wall part 42. In this manner, the tooth 36 and the teeth 38 of the link members 16 are surely and relatively easily prevented from causing the incorrect intermesh therebetween, before the key top 14 is fitted to the link members 16. Therefore, it is possible to fit the key top 14 to the link members 16 correctly intermeshed with each other. The key switch 10 thus assembled can achieve good touch during key-entry operation and superior stroke properties of the key top 14, with a proper interlocking action and a stable guiding function of the link members 16.

Figure 5A:
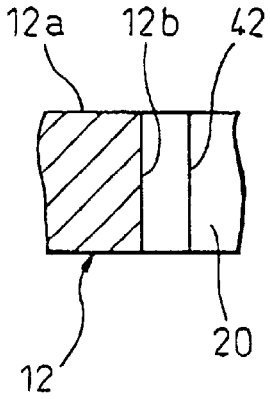
FIG. 5A is a sectional side view showing a projecting wall portion provided in the key switch of FIG. 1.

To surely prevent the protruding wall parts 42 of the base 12 from being an obstacle to the pivot supports 24 of the key top 14, it is desirable to form each protruding wall part 42 in such a manner that the cross-sectional shape of each wall part 42 is smaller than that of each axle 34 as taken along a plane orthogonal to the axis 40, as shown in FIG. 2. The protruding wall part 42 may have any shape, such as a prism (FIG. 4), a cylinder (FIG. 1), and so on. Also, the protruding wall part 42 may have a uniform height or thickness (FIG. 5A) measured from the inner peripheral surface 12*b*.

Figure 5B:
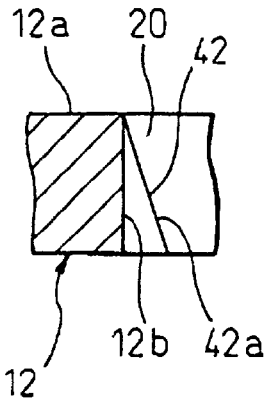
FIG. 5B is a sectional side view showing a modified projecting wall portion.

Alternatively, the protruding wall part 42 may have a gradually increased height or thickness (FIG. 5B) measured from the inner peripheral surface as seen in a direction away from the key top 14. The protruding wall part 42 with such a gradually increased height can smoothly guide the pivot support 24 of the key top 14 along the tapered surface 42*a* of the wall part 42 into the center opening 20. Thus, even if the protruding wall part 42 is formed larger than the axle 34 to be, e.g., entirely on the inner peripheral surface 12*b*, the wall part 42 is surely prevented from being an obstacle to the pivot support 24.

Figure 6:
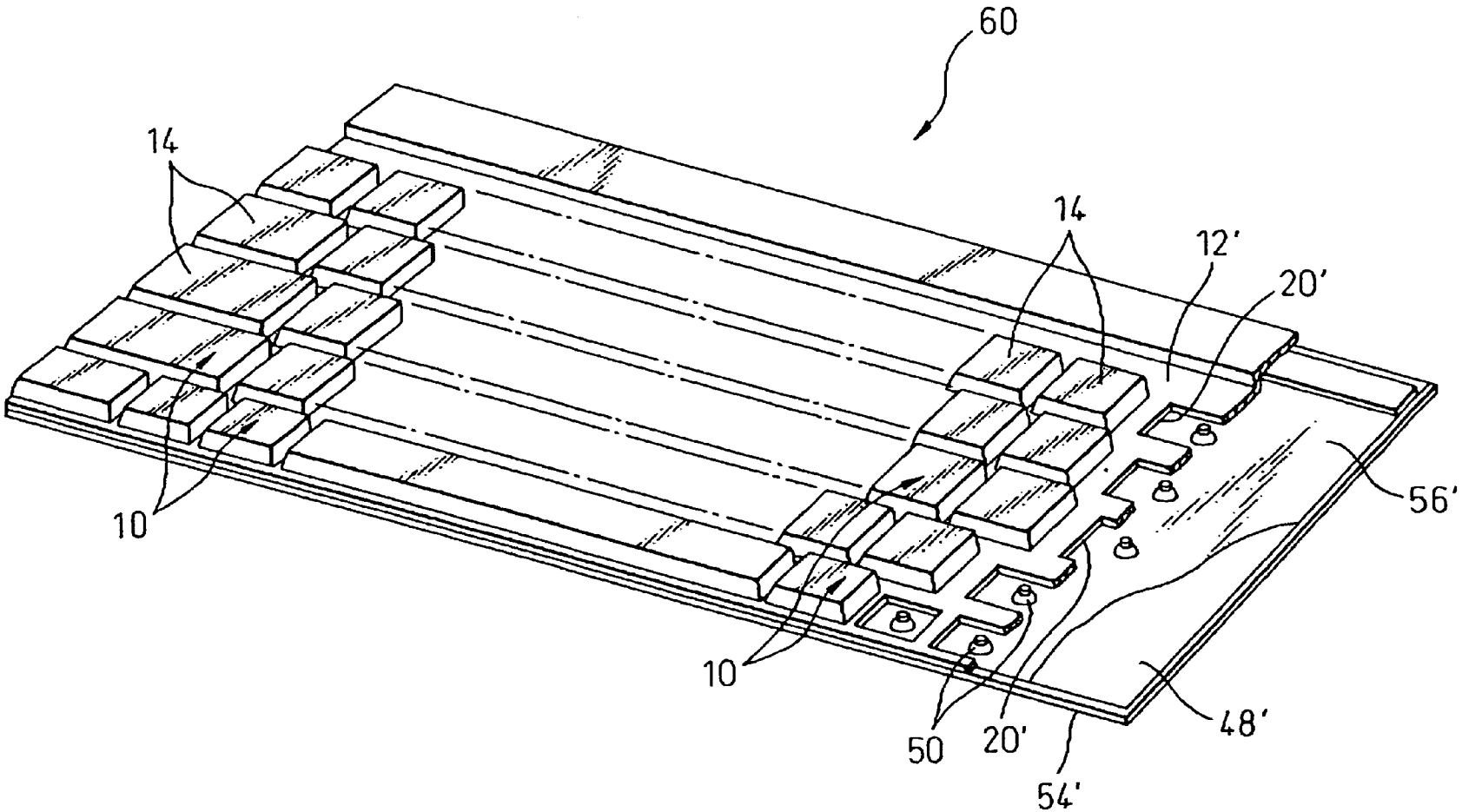
FIG. 6 is a partially cut-away perspective view showing a keyboard according to one embodiment of the present invention.

FIG. 6 shows a keyboard 60, according to an embodiment of the present invention, that incorporates a plurality of key switches 10 in arrays, each of which has an above-described structure. In the keyboard 60, the base 12, the membrane switch 48, the support plate 54 and the sheet member 56 fixed to the actuating member 50, provided in each key switch 10 described above, are formed as a large base 12' with plural openings 20', a large membrane switch 48', a large support plate 54' and a large sheet member 56' fixed to plural actuating members 50, which are commonly used for all the key switches 10 incorporated in the keyboard 60. The link members 16 of each key switch 10 are omitted from the drawing. Also, the key switch 10 and the keyboard 60, according to the present invention, may have various types of switching mechanism 18, other than the mechanism 18 having the dome-shaped actuating member 50 as described above.

In the assembling process of the keyboard 60, the link members 16 of the individual key switches 10 are laid in the respective openings 20' of the base 12' in such a manner as already described, and in this condition, the key tops 14 of all the key switches 10 are put on and press-fitted to the associated pair of link members 16 in a certain order. In this situation, the respective pairs of link members 16 of all the key switches 10 are relatively easily maintained in a correctly intermeshed state without requiring the skill of the operator, as already described. Consequently, it is no longer necessary to investigate and correct the intermeshing state, which can prevent an increase in the manufacturing cost of the keyboard 60, and therefore, it is possible to provide the keyboard 60 having good assembling properties and superior operability.

Figure 7:
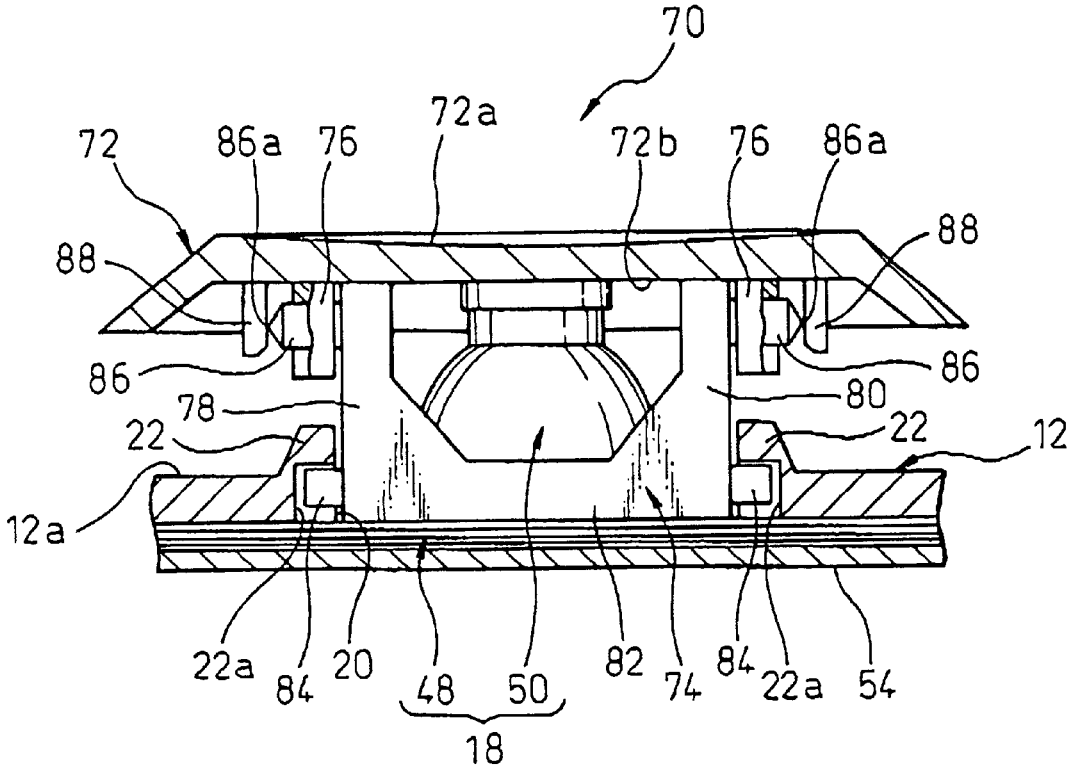
FIG. 7 is a sectional side view showing a key switch according to a second embodiment of the present invention.

FIG. 7 shows a key switch 70 according to a second embodiment of the present invention. The key switch 70 has a structure substantially identical to that of the key switch 10 shown in FIG. 1, except for the structure of a key top 72 and link members 74, so that corresponding components are denoted by the same reference numerals and the description thereof is not repeated. That is, the key switch 70 includes a base 12, a key top 72 disposed movably in a vertical or up-and-down direction on the major surface 12*a* of the base 12, a pair of link members 74 (only one link member 74 is shown in FIG. 7) for supporting the key top 72 above the base 12 and directing or guiding the key top 72 in the vertical direction, and a switching mechanism 18 capable of opening and closing contact points of an electric circuit in accordance with the vertical movement of the key top 72.

Figure 8:
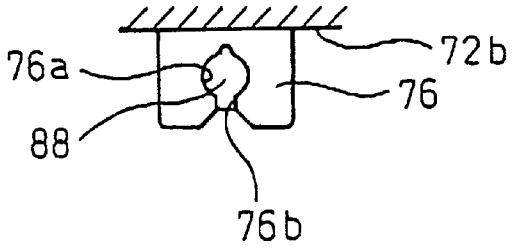
FIG. 8 is an enlarged view showing a part of a key top used in the key switch of FIG. 7.

The key top 72 is a dish-like member having a generally rectangular profile, and has an operating surface 72*a* adapted to be pressed by an operator's finger. The key top 72 is provided, on an inner surface 72*b* thereof opposite to the operating surface 72*a*, with two pairs of pivot supports 76 (only one pair is shown in FIG. 7), one pair being spaced from the other pair in the link-slide direction, in a way similar to the key top 14 shown in FIG. 3. Each of the pivot supports 76 is formed as a small plate uprightly projecting from the inner surface 72*b* of the key top 72, and includes a bearing hole 76*a* penetrating through the thickness of the plate and a slit 76*b* extending generally perpendicularly to the inner surface 72*b* to communicate with the bearing hole 76*a* (FIG. 8).

The pivot supports 76 in each pair are positioned on the inner surface 72*b* of the key top 72, in such a manner that the pivot supports 76 are spaced from each other at a distance allowing the end regions of arms 78, 80 of each link member 16 to be interposed therebetween as described later, and that the bearing holes 76*a* of respective pivot supports 76 are axially aligned with each other. Further, the pivot supports 76 in two pairs, disposed on the respective same sides, are aligned with each other in the link-slide direction on the inner surface 72*b* of the key top 72. Each pivot support 76 pivotably supports a second end region of each link member 74, as described later.

The link members 74 have shapes and dimensions substantially identical to each other. The link members 74 are assembled together into a reverse V-shape as seen in a lateral direction and meshed at toothed end regions thereof with each other, to form a gear-link type pair, in a way similar to the link members 16 shown in FIG. 2. Each of the link members 74 is slidably engaged or connected at a first, engagable end region thereof with the base 12 and pivotably engaged or connected at the toothed or second, engagable end region with the key top 72.

Each link member 74 includes a pair of arms 78, 80 extending generally parallel to each other and a connecting portion 82 integrally connecting the arms 78, 80 with each other. In the illustrated embodiment, the first end region of the link member 74 includes the connecting portion 82 and the thicker proximal end areas of the arms 78, 80 adjacent to the connecting portion 82, while the second end region includes the thinner distal end or parallel-length areas of the arms 78, 80 opposite to the proximal end areas.

A pair of axles 84 are formed in the first end region of each link member 74 in such a manner that the respective axles 84 mutually coaxially project on the opposite sides of the link member 74 and face away from the connecting portion 82. Also, a pair of axles 86 are formed in the second end region of each link member 74 in such a manner that the respective axles 86 mutually coaxially project on the opposite sides of the link member 74 or arms 78, 80 and extend parallel to the respective axles 84 in the same directions as the latter. Further in the second end region of each link member 74, a single tooth (not shown) is formed on the first arm 78 near the axle 86 so as to project outward from the distal end face of the arm 78, while double teeth (not shown) are formed on the second arm 80 near the axle 86 so as to project outward from the distal end face of the arm 80.

The axles 84 formed in the first end region of the link member 74 are slidably fitted or received in the respective guide grooves 22*a* of the associated slide supports 22 on the base 12, and the axles 86 formed in the second end region of the link member 74 are pivotably fitted or received in the respective bearing holes 76*a* of the associated pivot supports 76 on the key top 72, whereby each link member 74 is arranged between the base 12 and the key top 72 in such a manner as to be pivotable about the axles 86. In this situation, the link members 74 are joined with each other through an interlocking structure wherein the single tooth of the first arm 78 of each link member 74 is meshed with the double teeth of the second arm 80 of the counterpart link member 74. As a result, the link members 74 can rotate about pivot axes defined by respective pairs of axles 86 on the arms 78, 80 in a mutually interlocked manner.

Thus, when the link members 74 synchronously rotate about the respective axles 86 in opposite direction and the axles 84 of the link members 74 slide horizontally along the base 12, the key top 72 is subjected to a parallel displacement in a substantially vertical direction relative to the base 12, while keeping a predetermined, generally horizontal posture of the key top 72 wherein the operating surface 72*a* is substantially parallel to the major surface 12*a* of the base 12. The uppermost or initial position of key top 72 during a vertical or key-entry stroke thereof is determined at the instant when the interlocked sliding motion of the axles 84 of the respective link members 74 toward each other is stopped by the walls of the associated slide supports 22 defining the guide grooves 22*a* formed on the base 12. As the key top 72 moves downward from this uppermost position, the axles 84 of the respective link members 74 slidingly move away from each other in a direction generally perpendicular to the vertical direction. Once the key top 72 reaches a lowermost position of the key-entry stroke, the link members 74 are housed inside the inner surface 72*b* of the key top 72, and are at least partially received in the center opening 20 of the base 12.

In the key switch 70, the axles 86 formed in the second end region of each link member 74 are respectively fitted into the bearing holes 76*a* of the associated pivot supports 76 provided on the key top 72 in a loose-fit manner. Therefore, it may be facilitated to generate a backlash of each axle 86 in each bearing hole 76*a* due to the slit 76*b*, similar to the conventional key switch. To solve this problem, in the key-switch 70, the key top 72 is provided with four abutting plates 88 arranged near the respective pivot supports 76. Each abutting plate 88 is positioned at an outer side of each pivot support 76, opposite to an inner side thereof facing each arm 78, 80 of the link member 74, and is spaced from the pivot support 76 in parallel to the latter so as to align with the bearing hole 76*a* in an axial direction thereof. The abutting plate 88 is preferably made of a same material as the key top 72, and is formed integrally with the key top 72 to project upright from the inner surface 72*b*.

On the other hand, each axle.86 formed in the second end region of each link member 74 is provided with a conical axial end surface including an apex 86*a* located on the pivot axis of the axle 86. When the axles 86 on the arms 75, 80 of the link member 74 are respectively fitted into the bearing holes 76*a* of the pivot supports 76 of the key top 72, the axles 86 are abutted at the apexes 86*a* thereof to the abutting plates 88 positioned outside the associated pivot supports 76. In this respect, each axle 86 is dimensioned and each abutting plate 88 is positioned, in such a manner as to generate certain mutual pressure between the axle 86 and the abutting plate 88. Thus, at least one of the arms 78, 80 of the link member 74 and the associated abutting plates 88 of the key top 72 is elastically bent or deflected about the proximal fixed ends thereof due to the mutual pressure. As a result, the arms 78, 80 of each link member 74 are locally abutted or pressed, at the apexes 86*a* of the axles 86 located on the pivot axis of the arms 78, 80, onto the associated abutting plates 88 formed integrally with the key top 72, due to an elastic restoring force generated relatively in the arms 78, 80 and the abutting plates 88.

In the key switch 70 as described above, each axle 86 of the link member 74, fitted into the bearing hole 76*a* of each pivot support 76 of the key top 72 in a loose-fit manner, is constantly abutted at the apex 86*a* under certain pressure to the abutting plate 88 during the full key-entry stroke of the key top 72. Therefore, in spite of the fact that the slits 76*b* are formed in the pivot supports 76, the axle 86 is elastically supported by the abutting plate 88 and thus is effectively prevented from chattering in the bearing hole 76*a*. Also, the axle 86 is locally supported at the apex 86*a* located on the pivot axis thereof, so that a dynamic friction force caused between the axle 86 and the abutting plate 88 is minimized so as not to substantially affect the key-entry operation feeling or properties of the key top 72. Consequently, the key switch 70 can suppress the chattering of the link members 74, which may be caused due to the clearance between the pivot supports 76 of the key top 72 and the axles 86 of the link members 74, without deteriorating the key-entry operation properties, so that the fluctuation or wobble of the key top 72 and the resultant noise, which may be generated during the key-entry operation, can be reduced as much as possible or substantially eliminated.

Figure 9:
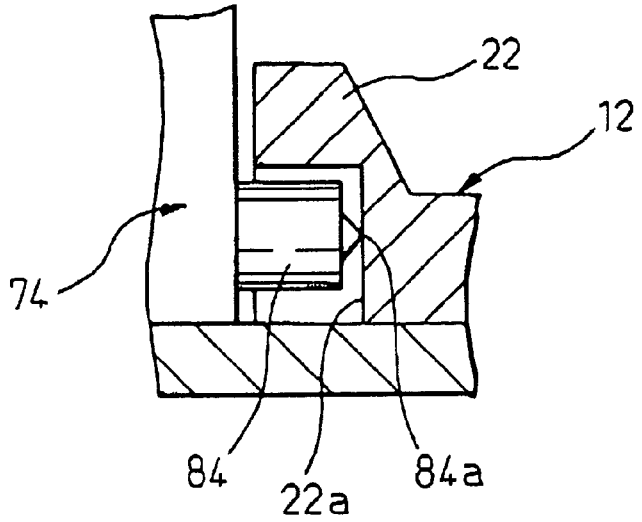
FIG. 9 is an enlarged view showing a part of a modified link member usable in the key switch according to the second embodiment.

In addition to or instead of the above-described arrangement, each link member 74 may be provided on each axle 84 formed in the first region with a conical axial end surface including an apex 84*a* located on the pivot axis of the axle 84, as shown in FIG. 9. In this arrangement, the axles 84 of each link member 74 and the slide supports 22 of the base 12 are shaped and dimensioned so that, when the axles 84 are respectively inserted into the guide grooves 22*a* of the associated slide supports 22, the axles 84 are constantly abutted at the apexes 84*a* thereof under certain pressure to the inner wall surfaces of the guide grooves 22*a* during the full key-entry stroke of the key top 72. This configuration can also suppress the chattering of the link members 74, without deteriorating the key-entry operation feeling or properties of the key top 72. It will be appreciated that, in the above arrangements, the apexes 84*a*, 86*a* of the axles 84, 86 may be located at the outside of the pivot axes of the axles 84, 86.

Figure 10:
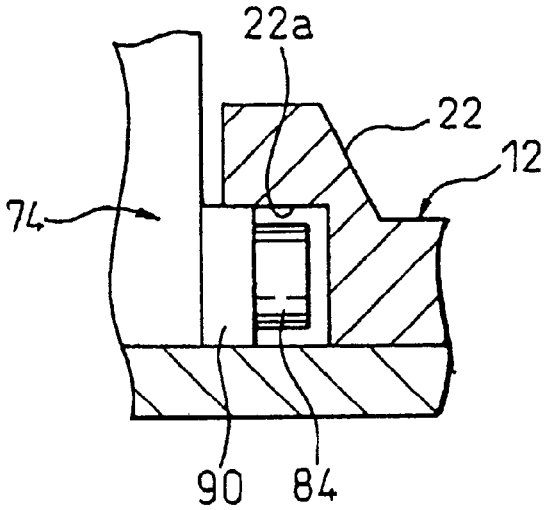
FIG. 10 is an enlarged view showing a part of another modified link member usable in the key switch according to the second embodiment.

Also, as shown in FIG. 10, each link member 74 may be provided on each axle 84 formed in the first region with an annular rib or enlarged diameter portion 90 circumferentially extending along a part of the axial length of the axle 84. In this arrangement, the axles 84 of each link member 74 and the slide supports 22 of the base 12 are shaped and dimensioned so that, when the axles 84 are respectively inserted into the guide grooves 22*a* of the associated slide supports 22, the axles 84 are constantly abutted or contacted locally at the annular ribs 90 thereof to the inner wall surfaces of the guide grooves 22*a* during the full key-entry stroke of the key top 72. This configuration can also suppress the chattering of the link members 74, without substantially deteriorating the key-entry operation feeling or properties of the key top 72, if the axial length of each annular rib 90 is reduced as much as possible. Also, the selection of the axial length of each annular rib 90 can suitably adjust the smoothness of the key-entry operation of the key top 72.

Figure 11:
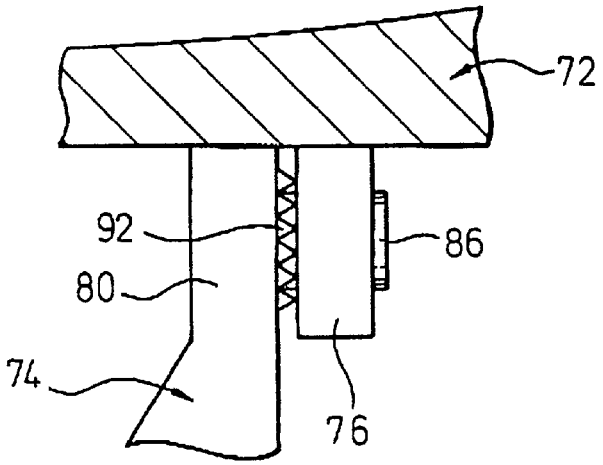
FIG. 11 is an enlarged view showing a part of a further modified link member usable in the key switch according to the second embodiment.

Moreover, as shown in FIG. 11, each link member 74 may be provided on the outer surface of each arm 78, 80 in the second end region with a local textured surface 92 located around the proximal end of the axle 86. In this arrangement, the local textured surfaces 92 of the arms 78, 80 of each link member 74 and the pivot supports 76 of the key top 72 are shaped and dimensioned so that, when the axles 86 are respectively fitted into the bearing holes 76*a* of the associated pivot supports 76, the arms 78, 80 are constantly abutted at the local textured surfaces 92 thereof under a certain pressure to the inside surfaces of the pivot supports 76 during the full key-entry stroke of the key top 72, due to an elastic restoring force generated relatively in the arms 78, 80 and the associated pivot supports 76. This configuration can also suppress the chattering of the link members 74, without substantially deteriorating the key-entry operation feeling or properties of the key top 72, if the area of each textured surface 92 is reduced or the roughness of the textured surface 92 is increased as much as possible. Also, the selection of the area or roughness of each textured surface 92 can suitably adjust the smoothness of the key-entry operation of the key top 72.

Figure 12:
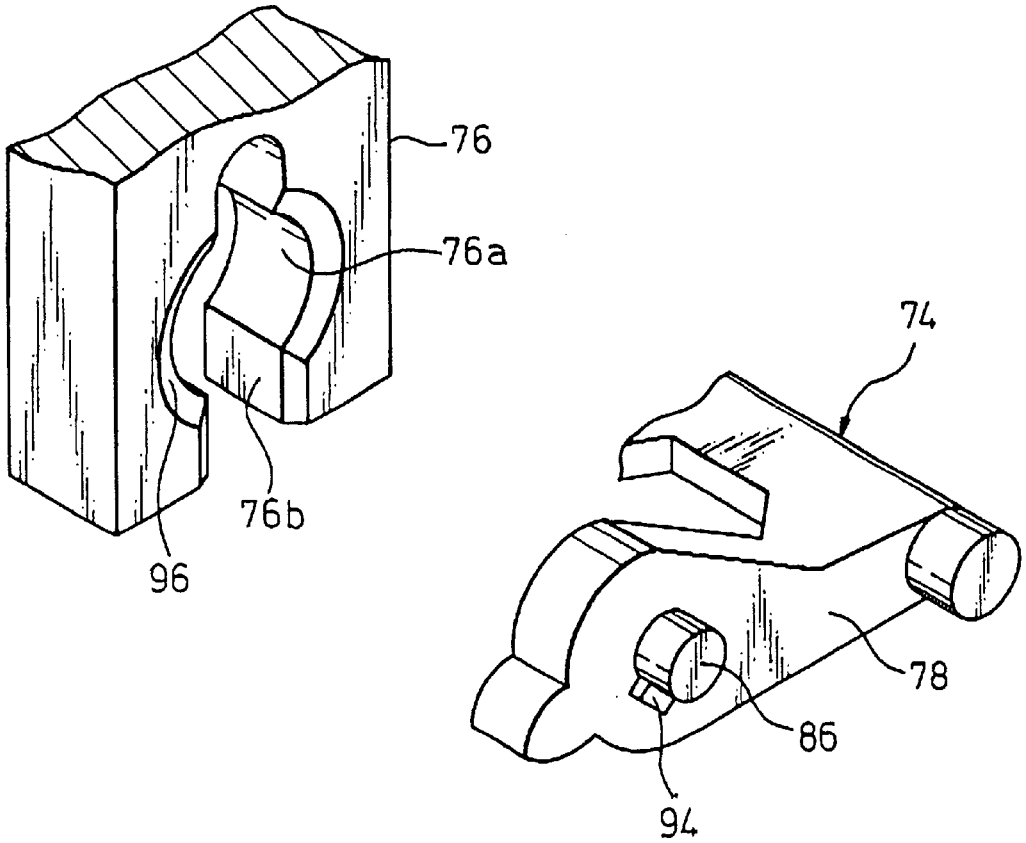
FIG. 12 is an enlarged view showing a part of yet further modified link member and pivot support, usable in the key switch according to the second embodiment.
Figure 13:
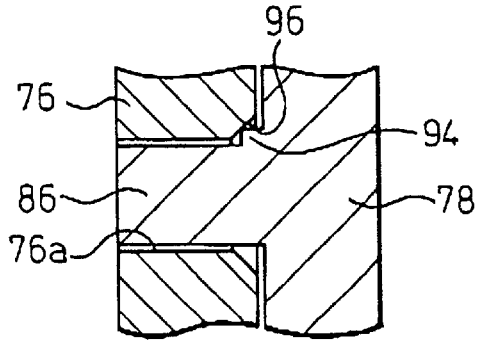
FIG. 13 is a sectional view showing the link member and the pivot support of FIG. 12 in an assembled state.

Furthermore, as shown in FIGS. 12 and 13, each link member 74 may be provided on the outer surface of each arm 78, 80 in the second end region with a local protuberance 94 located adjacent to the proximal end of the axle 86, and the key top 72 may be provided on the inside surface of each pivot support 76, oppositely facing the second end region of the link member 74, with a chamfered portion 96 located adjacent to the bearing hole 76*a* and the slit 76*b*. In this arrangement, the local protuberances 94 of the arms 78, 80 of each link member 74 and the chamfered portions 96 of the pivot supports 76 of the key top 72 are shaped and dimensioned so that, when the axles 86 are respectively fitted into the bearing holes 76*a* of the associated pivot supports 76, the arms 78, 80 are constantly abutted at the local protuberances 94 thereof under certain pressure to the chamfered portion 96 of the pivot supports 76 during the full key-entry stroke of the key top 72, due to an elastic restoring force generated relatively in the arms 78, 80 and the associated pivot supports 76. This configuration can also suppress the chattering of the link members 74, without substantially deteriorating the key-entry operation feeling or properties of the key top 72, if the mutually contact area between the protuberance 94 and the chamfered portion 96 is reduced as much as possible. Also, the selection of the shapes and dimensions of each protuberance 94 can suitably adjust the smoothness of the key-entry operation of the key top 72.

It will be appreciated that above-described various means for eliminating the chattering of the link members 74 by subjecting the axles 84, 86 of the link members 74 to the elastic restoring force generated relatively in several components may be applied not only to the key switch including the gear-link type pair of link members but also to the key switches including any other type pair of link members, such as the pantograph type pair or the modified pantograph type pair. For these applications, the inventive key switch may be described as comprising a pair of link members, each link member being provided in an end region thereof with an axle operatively engaged or connected with either a base or a key top, wherein at least a part of the link member in the end region is locally abutted or pressed onto the base or the key top under an elastic restoring force generated relatively in the link member and the base or the key top with which the link member is engaged. Also, some or all of the above-described various arrangements may be suitably combined with each other, so as to more effectively suppress the chattering of the link members.

A keyboard, such as the keyboard 60 shown in FIG. 6, may be constituted by incorporating a plurality of key switches 70 in arrays, each key switches 70 having an above-described structure of the second embodiment. The keyboard having such a constitution can establish superior operability of the key switches 70, in which the fluctuation or wobble and the resultant noise of the key tops 72 are effectively reduced while maintaining the good key-entry operation properties thereof.

Figure 14:
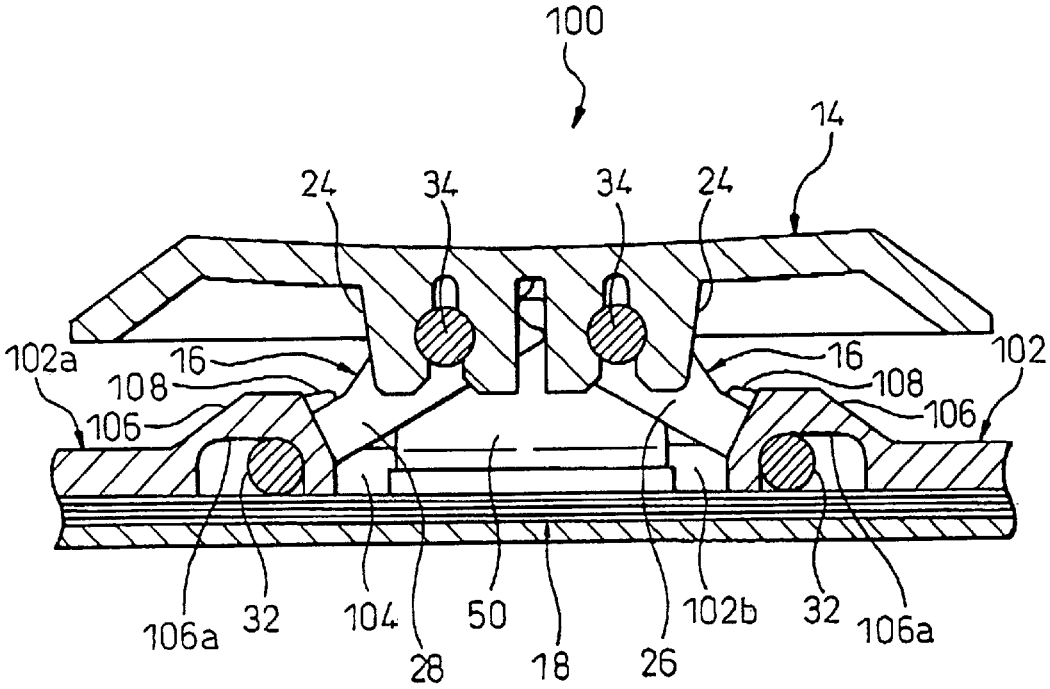
FIG. 14 is a vertical sectional view showing a key switch according to a third embodiment of the present invention in an assembled state.

FIG. 14 shows a key switch 100 according to a third embodiment of the present invention. The key switch 100 has a structure substantially identical to that of the key switch 10 shown in FIG. 1, except for the structure of a base 102, so that corresponding components are denoted by the same reference numerals and the description thereof is not repeated. That is, the key switch 100 includes a base 102, a key top 14 disposed movably in a vertical or up-and-down direction on the major surface 102*a* of the base 102, a pair of link members 16 for supporting the key top 14 above the base 102 and directing or guiding the key top 14 in the vertical direction, and a switching mechanism 18 capable of opening and closing contact points of an electric circuit in accordance with the vertical movement of the key top 14.

Figure 15:
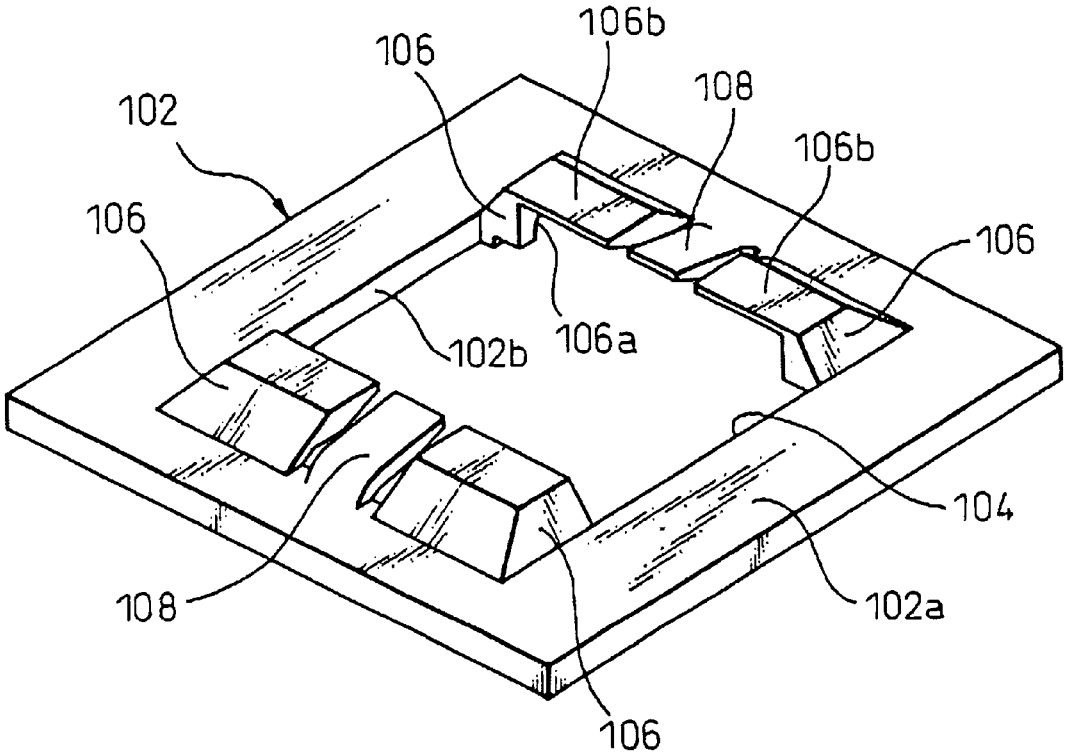
FIG. 15 is a perspective view showing a base used in the key switch of FIG. 14.

As shown in FIGS. 14 and 15, the base 102 is a frame-like member having a generally rectangular center opening 104 arranged to be covered by the key top 14. The base 102 is provided, along a pair of opposed inner peripheral surfaces 102*b* thereof defining the center opening 104, with two pairs of slide supports 106, one pair being spaced from the other pair in a link-slide direction (i.e., leftward and rightward directions in FIG. 14). Each of the slide supports 106 includes a wall portion extending and projecting from the major surface 102*a* and the inner peripheral surface 102*b* of the base 102, and a guide groove 106*a* is formed inside the wall portion so as to extend generally parallel to the major surface 102*a*.

The slide supports 106 in each pair are positioned on the opposed inner surfaces 102*b* of the base 102 in such a manner that the guide grooves 106*a* of respective slide supports 106 are disposed at locations corresponding to each other. Further, the slide supports 106 in two pairs, disposed on the respective same sides, are aligned with each other in the link-slide direction along the corresponding inner peripheral surfaces 102*b* of the base 102. Each slide support 106 slidably supports an axle 32 formed in a first, engagable end region of each link member 16. Each slide support 106 is also provided with a top wall 106*b* extending above a corner area of the center opening 104.

The base 102 is further provided, on another pair of opposed inner peripheral surfaces 102*c* thereof (FIG. 16A) defining the center opening 104, with a pair of buffer plates 108 opposed to each other, each of which is located between the slide supports 106 in each pair and extending above a part of the center opening 104. Each of the buffer plates 108 is integrally joined at the proximal end thereof to the base 102, and extends at the distal free-end region thereof above the first end region of each link member 16 of which the axles 32 are engaged with the associated pair of slide supports 106. Each buffer plate 108 can be elastically bent to be pivotable about the proximal end thereof independently of the top walls 106*b* of the adjacent slide supports 106.

Figure 16A:
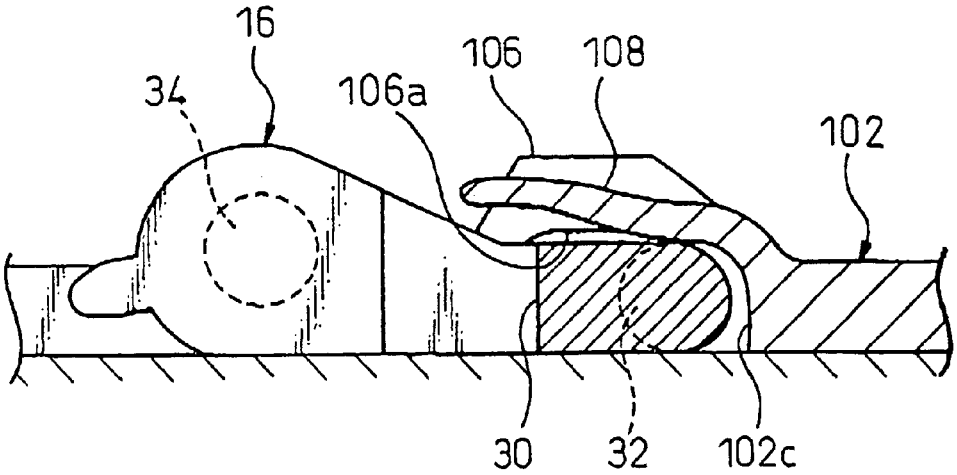
FIGS. 16A and 16B are enlarged partial sectional views respectively showing a function of a buffering portion provided in the key switch of FIG. 14 at positions corresponding respectively to the lowermost and uppermost positions of a key top in a key-entry stroke.
Figure 16B:
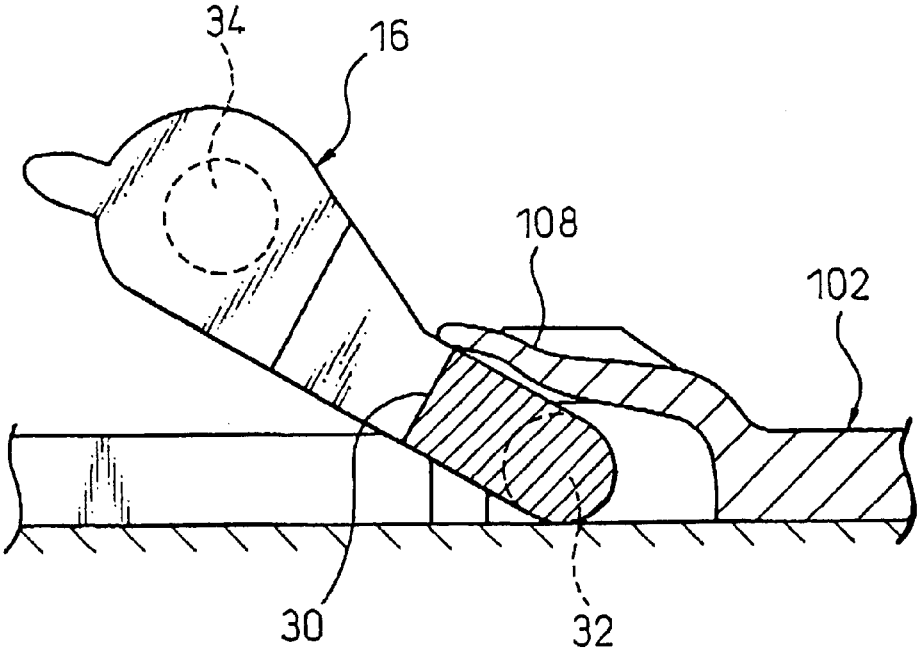

As shown in FIG. 16A, each buffer plate 108 formed on the base 102 is left in an unloaded or unstressed condition at a position upwardly away from the first end region of the link member 16 during the time when the key top 14 is in a lowermost position of a key-entry stroke. As the key top 14 moves from the lowermost position toward an initial or uppermost position in the key-entry stroke, the axles 32 formed in the first end regions of the link members 16 shift in a direction toward each other along the associated slide supports 106, and simultaneously the connecting portions 30 of the link members 16 gradually approach the associated buffer plates 108. Then, just before the key top 14 reaches the uppermost position, the connecting portions 30 of the link members 16 respectively collide with the buffer plates 108 (see FIG. 16B). As a result, each buffer plate 108 is elastically bent about the proximal end thereof, and the free end region thereof is upwardly shifted.

In the key switch 100 as described above, when a downward pushing force to the key top 14 is released in the key-entry operation and the key top 14 is moved from the lowermost position toward the uppermost position in the key-entry stroke by the biasing force of the elastic actuating member 50 under the guiding action of the link members 16, the connecting portions 30 of the link members 16 collide with the free end regions of the associated buffer plates 108 just before the axles 32 formed in the first end region of each link member 16 are abutted, at the outer circumferential surfaces of the axles 32, to and stopped by the walls of the respective slide supports 106. At this time, the buffer plates 108 are elastically bent about the proximal ends thereof, and thus serve as buffering means for gradually braking the pivoting motion of the link members 16, i.e., the sliding motion of the axles 32 in the first end regions. Consequently, a collision noise generated between the components at the instant when the key top 14 reaches the uppermost position of the key-entry stroke, i.e., when the axles 32 collide on the outer circumferential surfaces thereof with the walls of the associated slide supports 106, can be significantly reduced.

It is important that, in the key switch 100, the connecting portions 30 of the link members 16 respectively collide with the free end regions of the associated buffer plates 108 just before the key top 14 reaches the uppermost position of the key-entry stroke, to reduce or minimize any influences on the vertical movement of the key top 14 and the key-entry operation feeling or properties of the latter. The buffer plates 108 may be made of the same material as the base 102, and may also be formed integrally with the base 102. Also, the selection of the shapes and dimensions of each buffer plate 108 can optimize the collision noise reduction effect due to the buffer plate 108.

Figure 17:
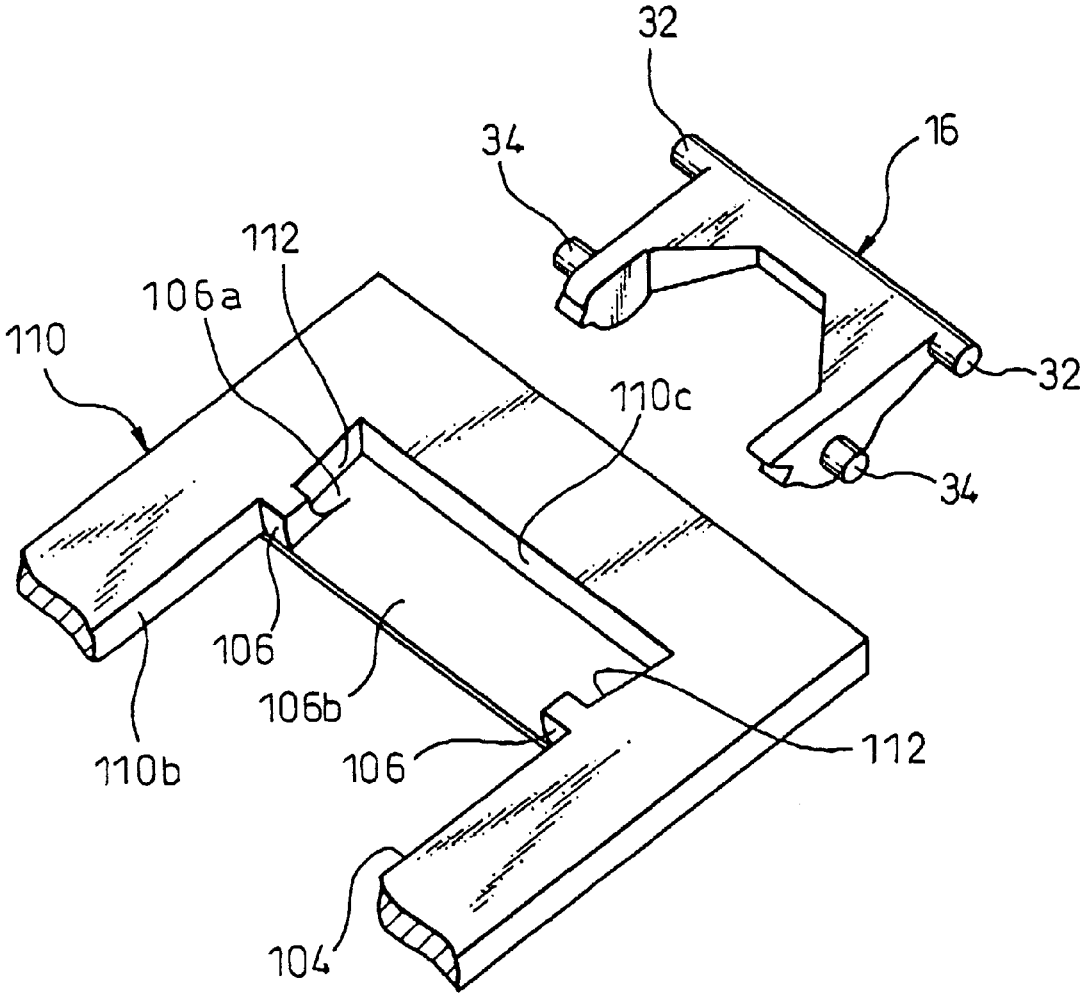
FIG. 17 is a perspective view showing a part of a modified base usable in the key switch according to the third embodiment as seen from the bottom side.

FIG. 17 shows a major part of a modified base 110 including another type of buffering portion instead of the above-described buffer plate 108. The base 110 has a structure substantially identical to that of the base 102 as described, except for the structure of the buffering portion, so that corresponding components are denoted by the same reference numerals and the description thereof is not repeated. The base 110 is provided, along a pair of opposed inner peripheral surfaces 10*b* thereof, with two pairs of slide supports 106 (only one pair is shown in FIG. 17). A single top wall 106*b* is provided for one pair of slide supports 106 so as to extend therebetween and above a part of a center opening 104.

Each slide support 106 includes a slanted inner wall surface 112 defining a guide groove 106*a*, which is adapted to face the axial end surface of the axle 32 in the first end region of the link member 16. The slanted wall surface 112 extends slightly obliquely in relation to the inner peripheral surface 10*b*, and intersects in an acute angle to the adjacent inner peripheral surface 110*c* of the base 110. In one pair of slide supports 106 engaging with the axles 32 formed in the first end region of one link member 16, the distance between the slanted wall surfaces 112 is maximum at the intersections with the inner peripheral surface 110*c*, and is minimum at the intersections with the inner wall surface of the slide supports 106 facing oppositely to the inner peripheral surface 110*c*. The minimum distance between the slanted wall surfaces 112 is designed to be slightly shorter than the distance between the axial end surfaces of the axles 32 of the link member 16.

Figure 18A:
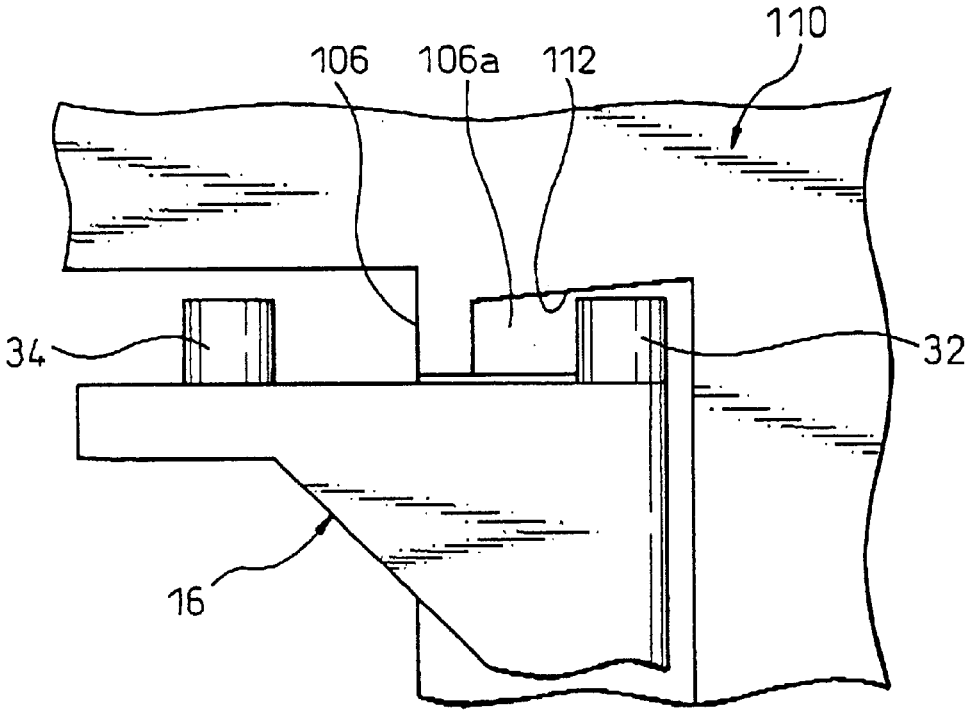
FIGS. 18A and 18B are enlarged partial bottom views respectively showing a function of a buffering portion provided in the base of FIG. 17 at positions corresponding respectively to the lowermost and uppermost positions of a key top in a key-entry stroke.

The slanted wall surfaces 112 of the base 110 serve as buffering means for reducing collision noise between some components, in a manner substantially different from the buffer plates 108 provided in the base 102. As shown in FIG. 18A, the axial end surface of each axle 32 in the first end region of the link member 16 can be left away from the slanted wall surface 112 of the associated slide support 106 of the base 110 during the time when the key top 14 (FIG. 14) is in a lowermost position of a key-entry stroke. That is, in this state, the first end region of the link member 16 is not held under pressure between the slanted wall surfaces 112 of the pair of slide supports 106.

Figure 18B:
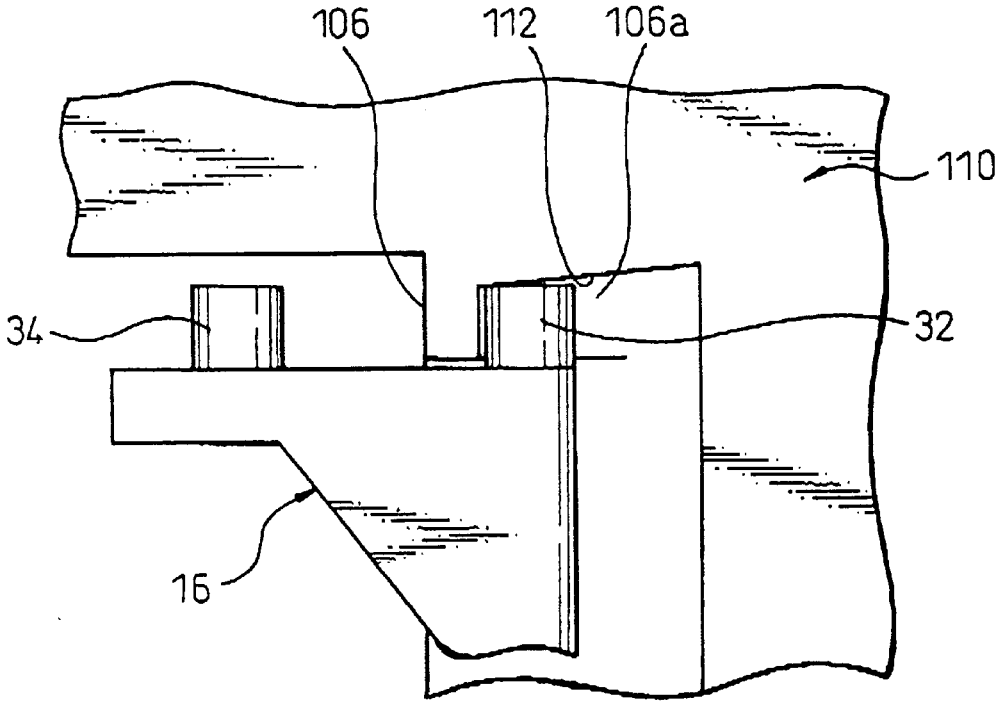

As the key top 14 moves from the lowermost position toward an initial or uppermost position in the key-entry stroke, the axles 32 formed in the first end regions of the link members 16 shift in a direction toward each other along the associated slide supports 106, and simultaneously the axial end surfaces of the axles 32 of each link member 16 gradually approach the associated slanted wall surfaces 112. Then, just before the key top 14 reaches the uppermost position, the axles 32 of each link member 16 respectively collide at the axial end surfaces thereof with the slanted wall surfaces 112 (see FIG. 18B).

In the base 110 as described above, when the key top 14 is moved from the lowermost position toward the uppermost position in the key-entry stroke by the biasing force of the elastic actuating member 50 (FIG. 14) under the guiding action of the link members 16, the axles 32 of each link member 16 respectively collide at the axial end surfaces thereof with the slanted wall surfaces 112 just before the axles 32 in the first end region of each link member 16 are abutted, at the outer circumferential surfaces of the axles 32, to and stopped by the walls of the respective slide supports 106. In this respect, the collision between each axle 32 and each slanted wall surface 112 is caused in such a manner that a contact pressure generated therebetween in a sliding motion relative to each other is gradually increased. Thus, the slanted wall surfaces 112 serve as buffering means for gradually braking the pivoting motion of the link members 16, i.e., the sliding motion of the axles 32 in the first end regions. Consequently, a collision noise generated between the components at the instant when the key top 14 reaches the uppermost position of the key-entry stroke, i.e., when the axles 32 collide on the outer circumferential surfaces thereof with the walls of the associated slide supports 106, can be significantly reduced.

Figure 19:
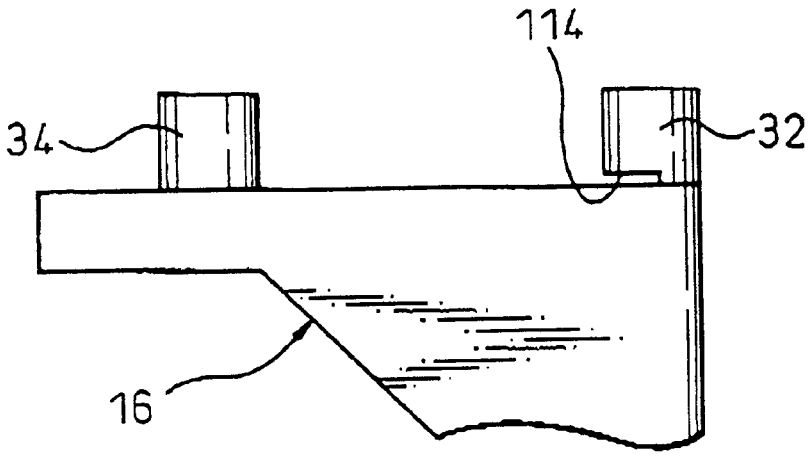
FIG. 19 is a plan view showing a part of a modified link member usable with the base of FIG. 17.

To assist the buffering effect of the slanted wall surfaces 112, it is preferred to form a slit 114 at a proximal end of each axle 32 in the first end region of the link member 16 (see FIG. 19). The slit 114 extends in a radial direction and opens locally in the outer circumferential surface of the axle 32. The axle 32 including the slit 114 can be elastically deflected or pivoted about the proximal or connecting end of the axle 32 at the instant when the axle 32 collides with the slanted wall surface 112, and thereby the collision noise between the components can be more effectively reduced.

Figure 20:
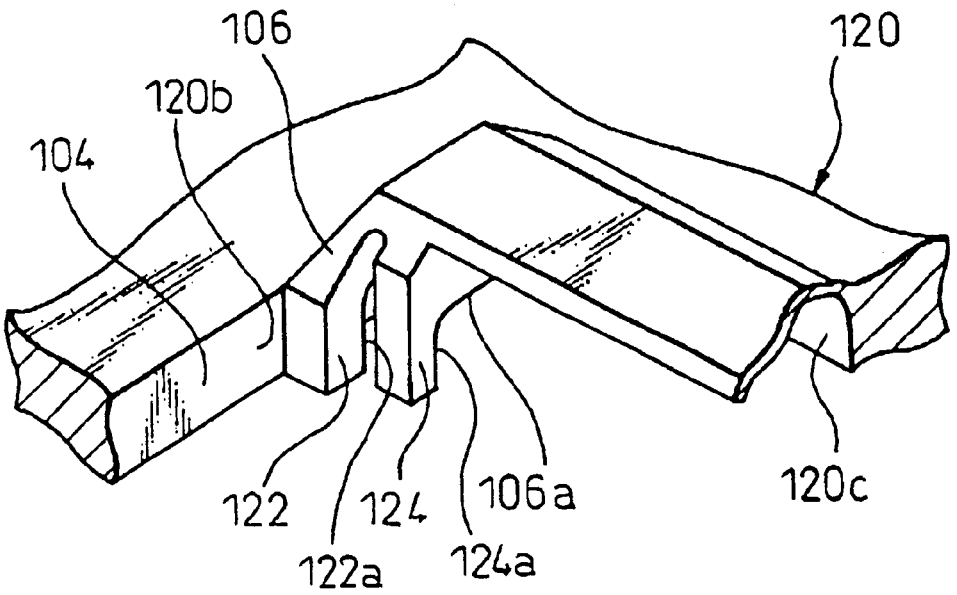
FIG. 20 is a perspective view showing a part of another modified base usable in the key switch according to the third embodiment.

FIG. 20 shows a major part of another modified base 120 including a yet another type of buffering portion. The base 120 has a structure substantially identical to that of the base 102 as described, except for the structure of the buffering portion, so that corresponding components are denoted by the same reference numerals and the description thereof is not repeated. The base 120 is provided, along a pair of opposed inner peripheral surfaces 120*b* thereof, with two pairs of slide supports 106 (only one slide support 106 is shown in FIG. 20).

Each slide support 106 includes a stop wall 122 defining a guide groove 106*a*, which is spaced from one of another pair of inner peripheral surfaces 120*c* defining a center opening 104 of the base 120, and a buffer plate 124 is formed adjacent to the stop wall 122. The buffer plate 124 includes a proximal end integrally joined to the slide support 106, and a free end region extending downward from the proximal end and adapted to be located laterally close to one arm 26, 28 of the link member 16 (FIG. 14) of which the axle 32 is engaged with the slide support 106.

The stop wall 122 of the slide support 106 is provided with an inner wall surface 122*a* defining a guide groove 106*a* and oppositely facing the inner peripheral surface 120*c* of the base 120. The buffer plate 124 is also provided with an inner wall surface 124*a* oppositely facing the inner peripheral surface 120*c* of the base 120. The inner wall surface 124*a* of the buffer plate 124 is located adjacent to the inner wall surface 122*a* of the stop wall 122, but is slightly deviated from the adjacent inner wall surface 122*a* into the guide groove 106*a*, i.e., nearer than the inner wall surface 122*a* to the inner peripheral surface 120*c* of the base 120 (see FIG. 21A). The buffer plate 124 can be elastically bent to be pivotable about the proximal end thereof independently of the adjacent stop wall 122.

Figure 21A:
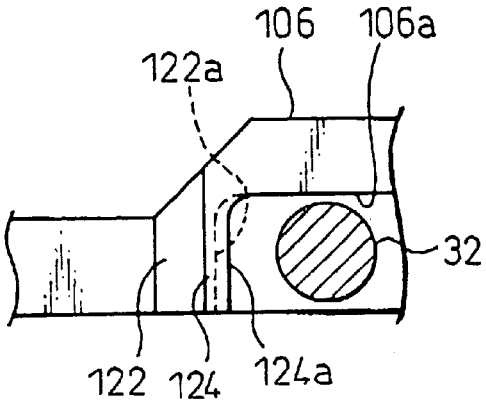
FIGS. 21A and 21B are enlarged partial sectional views respectively showing a function of a buffering portion provided in the base of FIG. 20 at positions corresponding respectively to the midway and uppermost positions of a key top in a key-entry stroke.
Figure 21B:
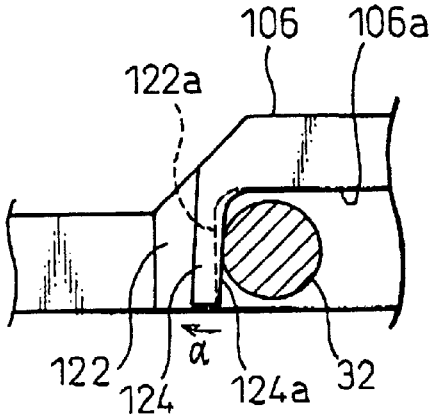

The buffer plates 124 of the base 120 serve as buffering means for reducing collision noise between some components, in a manner similar to the buffer plates 108 provided in the base 102. As shown in FIG. 21A, each axle 32 in the first end region of the link member 16 is left away from each buffer plate 124 adjacent to the associated slide support 106 during the time when the key top 14 (FIG. 14) is located within a predetermined distance from a lowermost position of a key-entry stroke. As the key top 14 moves from the lowermost position toward an initial or uppermost position in the key-entry stroke, the axles 32 formed in the first end regions of the link members 16 shift in a direction toward each other along the associated slide supports 106, and simultaneously the axles 32 of each link member 16 gradually approach the associated buffer plates 124 Then, just before the key top 14 reaches the uppermost position, the axles 32 of each link member 16 respectively collide at the outer circumferential surfaces thereof with the buffer plates 124 (see FIG. 21B). As a result, each buffer plate 124 is elastically bent about the proximal end thereof, and the free end region thereof is shifted in a direction shown by an arrow a (FIG. 21B).

In the base 120 as described above, when the key top 14 is moved from the lowermost position toward the uppermost position in the key-entry stroke by the biasing force of the elastic actuating member 50 (FIG. 14) under the guiding action of the link members 16, the axles 32 of each link member 16 respectively collide at the circumferential surfaces thereof with the buffer plates 124 just before the axles 32 in the first end region of each link member 16 are abutted, at the outer circumferential surfaces of the axles 32, to and stopped by the stop walls 122 of the respective slide supports 106. At this time, the buffer plates 124 are elastically bent about the proximal ends thereof, and thus serve as buffering means for gradually braking the pivoting motion of the link members 16, i.e., the sliding motion of the axles 32 in the first end regions. Consequently, a collision noise generated between the components at the instant when the key top 14 reaches the uppermost position of the key-entry stroke, i.e., when the axles 32 collide on the outer circumferential surfaces thereof with the stop walls 122 of the associated slide supports 106, can be significantly reduced.

Figure 22:
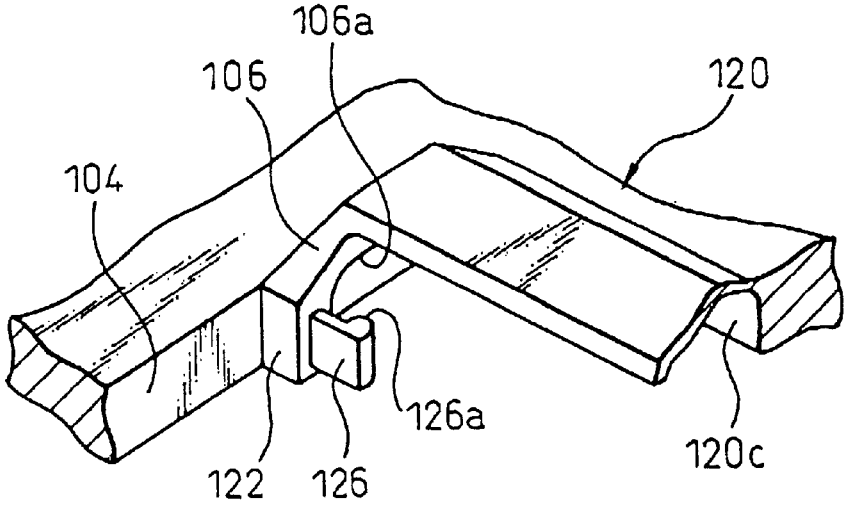
FIG. 22 is a perspective view showing a part of a further modified base usable in the key switch according to the third embodiment.

FIG. 22 shows a modified buffer plate 126 capable of being used in place of the buffer plate 124. The buffer plate 126 extends laterally from the adjacent stop wall 122, and includes a free end region adapted to be located laterally close to one arm 26, 28 of the link member 16 (FIG. 14) of which the axle 32 is engaged with the slide support 106. The buffer plate 126 is provided at the end of the free end region with a bump 126*a* oppositely facing the inner peripheral surface 120*c* of the base 120. The bump 126*a* of the buffer plate 126 is slightly deviated from the adjacent inner wall surface 122*a* (FIG. 21A) of the stop wall 122 into the guide groove 106*a*, i.e., nearer than the inner wall surface 122*a* to the inner peripheral surface 120*c* of the base 120. The buffer plate 126 can be elastically bent to be pivotable about the proximal end thereof independently of the adjacent stop wall 122, so as to reduce the collision noise, in the same manner as the buffer plate 124.

Figure 23:
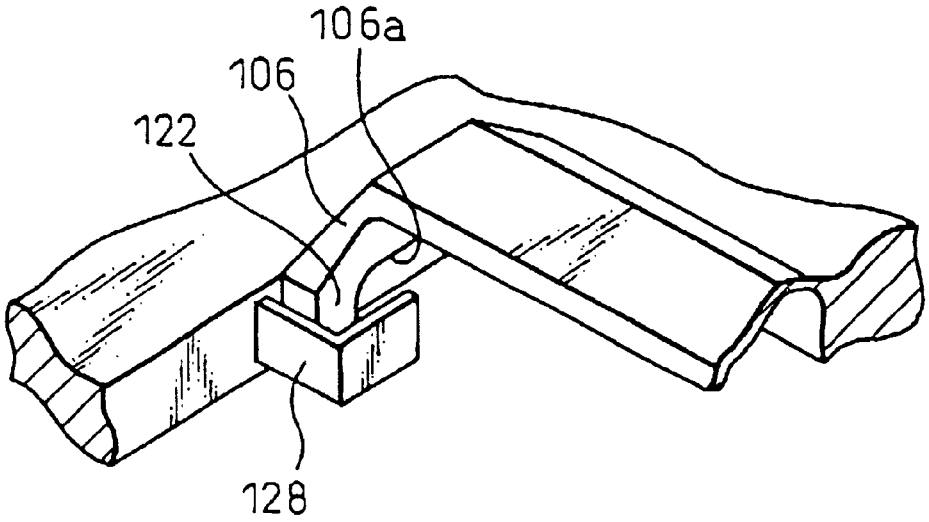
FIG. 23 is a perspective view showing a part of a yet further modified base usable in the key switch according to the third embodiment.

It will be appreciated that the buffer plates 124, 126 should be shaped and dimensioned so as not to interfere with the interlocked pivoting motion of the link members 16. From this viewpoint, as shown in FIG. 23, a buffer plate 128 formed separately from the stop wall 22 and including an elastically deformable portion lager than that of the buffer plate 124, 126 is advantageously used.

Figure 24:
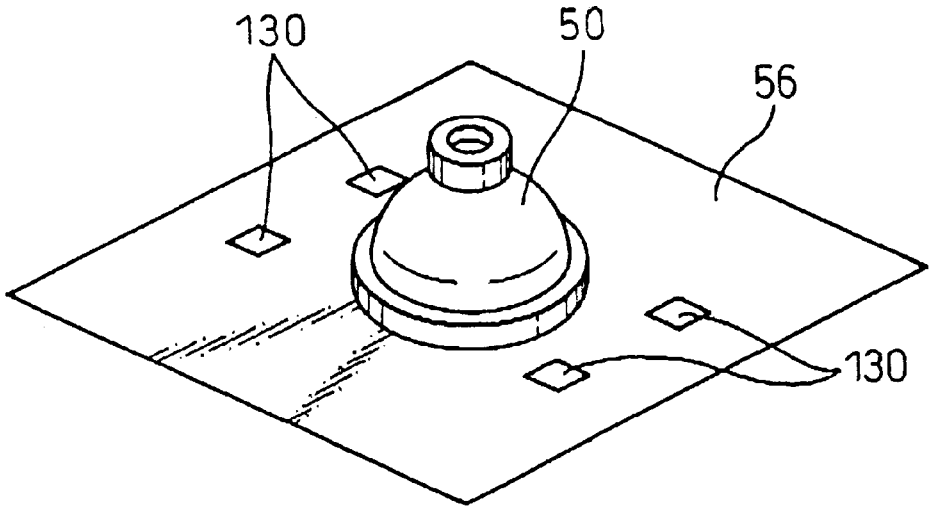
FIG. 24 is a perspective view showing a modified sheet member usable in the key switch according to the third embodiment.
Figure 25A:
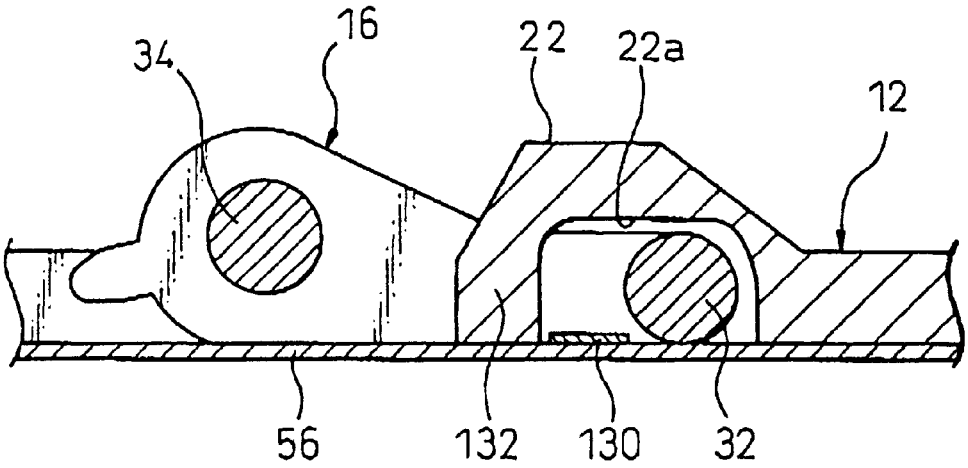
FIGS. 25A and 25B are enlarged partial sectional views respectively showing a function of a buffering portion provided in the sheet member of FIG. 24 at positions corresponding respectively to the lowermost and uppermost positions of a key top in a key-entry stroke.

FIG. 24 shows a yet another type of buffering portion capable of being used in place of the above-described buffering portion formed on the base of the key switch. This buffering portion is provided on the sheet member 56 fixedly connected with the actuating member 50, the sheet member 56 being described with reference to FIG. 1 as located under the base 12 in the key switch 10. That is, the sheet member 56 is provided on the upper side thereof with a plurality of high-friction areas 130, as buffering portions, located at positions respectively corresponding to the guide grooves 22*a* of the slide supports 22 of the base 12. As shown in FIG. 25A, each high-friction area 130 is adapted to be positioned close to a stop wall 132 of the associated slide support 22 within the guide groove 22*a* of the latter, the stop wall 132 acting to define the uppermost position of the key top 14 in the key-entry stroke.

The high-friction areas 130 may be formed from coatings of a material capable of providing a high-friction surface in a dried condition, such as a silicone adhesive, applied on the upper side of the sheet member 56. In this case, it is advantageous that an adhesive identical to an adhesive attaching the actuating member 50 to the sheet member 56 is used for forming the high friction areas 130. In this arrangement, the high-friction areas 130 can be formed simultaneously in an adhesive application step for attaching the actuating member 50, which simplifies the manufacturing process of the key switch.

Figure 25B:
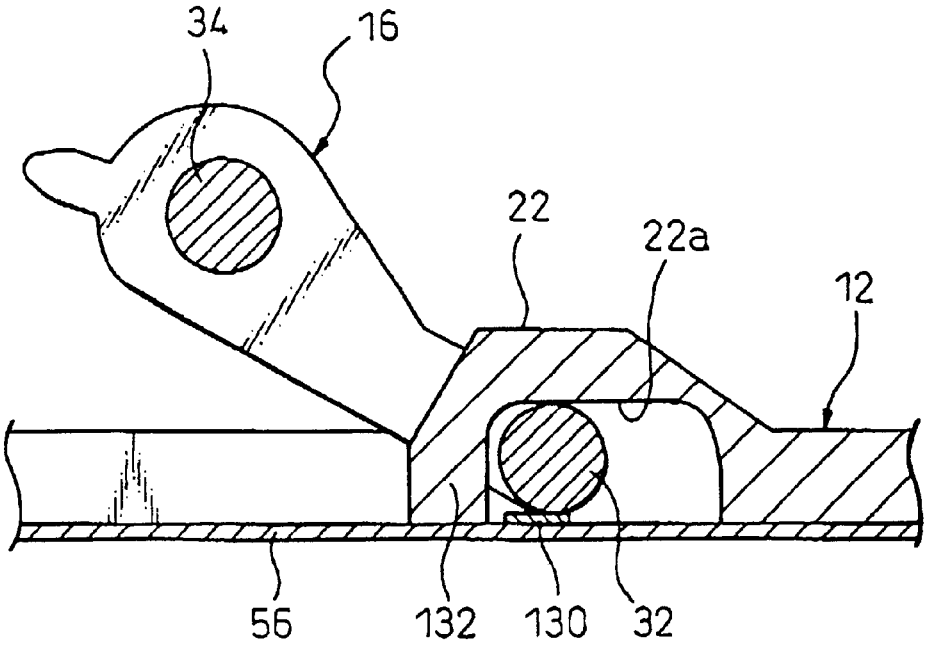

The high-friction areas 130 of the sheet member 56 serve as buffering means for reducing collision noise between some components, in a manner substantially different from the buffer plates 108 provided in the base 102. As shown in FIG. 25A, each axle 32 in the first end region of each link member 16, which shifts in accordance with the vertical movement of the key top 14 (FIG. 14), is kept away from each high-friction area 130 provided on the sheet member 56 in the guide groove 22*a* of the associated slide support 22 during the time when the key top 14 is located within a predetermined distance from a lowermost position of a key-entry stroke. As the key top 14 moves from the lowermost position toward an initial or uppermost position in the key-entry stroke, the axles 32 in the first end regions of the link members 16 shift in a direction toward each other along the associated slide supports 22, and simultaneously the axles 32 of each link member 16 gradually approach the associated high-friction areas 130. Then, just before the key top 14 reaches the uppermost position, the axles 32 of each link member 16 respectively run at the outer circumferential surfaces thereof onto the high-friction areas 130 (see FIG. 25B).

In the above arrangement, when the key top 14 is moved from the lowermost position toward the uppermost position in the key-entry stroke by the biasing force of the elastic actuating member 50 under the guiding action of the link members 16, the axles 32 of each link member 16 respectively run at the outer circumferential surfaces thereof onto the high-friction areas 130 just before the axles 32 in the first end region of each link member 16 are abutted, at the circumferential surfaces of the axles 32, to and stopped by the stop walls 132 of the respective slide supports 22. At this time, the high-friction areas 130 exert a relatively high dynamic friction force against the axles 32, and thus serve as buffering means for gradually braking the pivoting motion of the link members 16, i.e., the sliding motion of the axles 32 in the first end regions. Consequently, a collision noise generated between the components at the instant when the key top 14 reaches the uppermost position of the key-entry stroke, i.e., when the axles 32 collide on the outer circumferential surfaces thereof with the stop walls 132 of the associated slide supports 22, can be significantly reduced.

It will be appreciated that above-described various buffering portions for reducing the collision noise generated between the components at the instant when the key top 14 reaches the uppermost position of the key-entry stroke may be applied not only to the key switch including the gear-link type pair of link members but also to the key switches including any other type pair of link members, such as the pantograph type pair or the modified pantograph type pair. For these applications, the inventive key switch may be described as comprising a pair of link members, each link member being provided with an end region slidably engaged or connected with either a base or a key top, and a buffering portion for gradually braking the sliding motion of the end region of each link member relative to the base or the key top caused in accordance with the vertical movement of the key top just before the key top reaches the uppermost position of a key-entry stroke. Also, some or all of the above-described various buffering portions may be suitably combined with each other, so as to more effectively reduce the collision noise of the components.

A keyboard, such as the keyboard 60 shown in FIG. 6, may be constituted by incorporating a plurality of key switches 100 in arrays, each key switches 100 having an above-described structure of the third embodiment. The keyboard having such a constitution can establish superior operability of the key switches 100, in which the collision noise generated between the components at the instant when the key top reaches the uppermost position of a key-entry stroke, and therefore, can be used under a certain situation demanding quietness.

Figure 26:
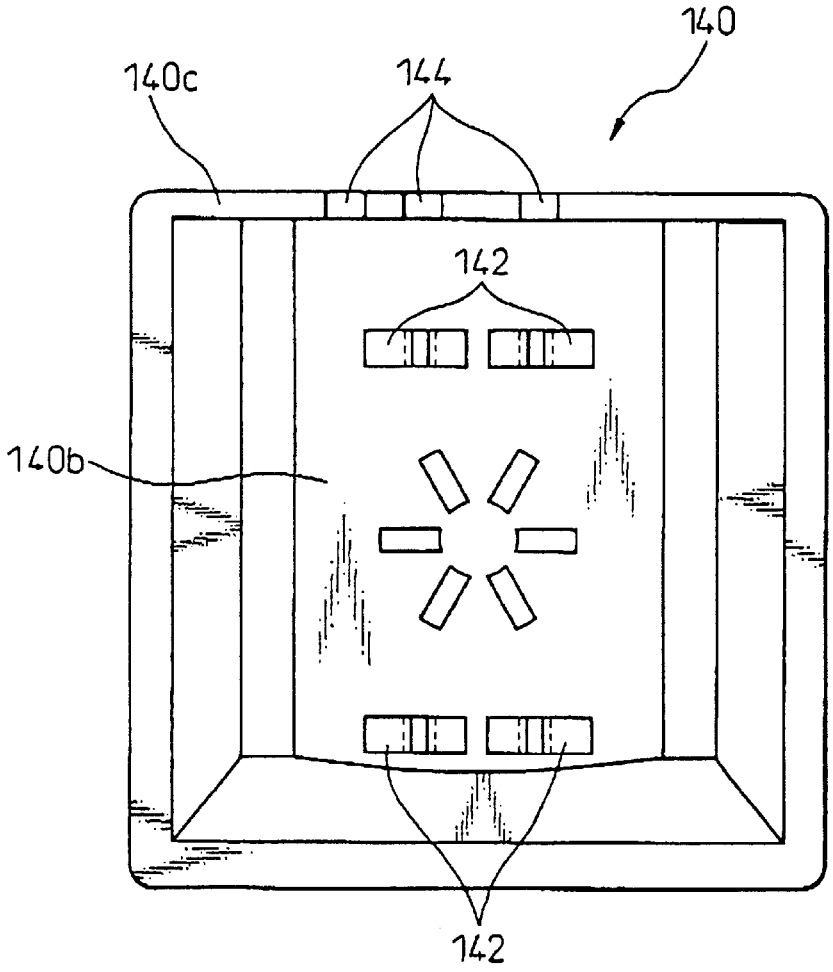
FIG. 26 is a bottom view showing a key top used in a key switch according to a fourth embodiment of the present invention.
Figure 27:
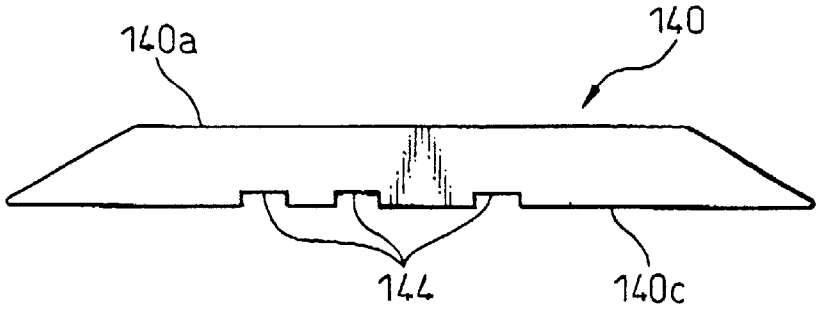
FIG. 27 is a side view showing a key top of FIG. 26.
Figure 28A:
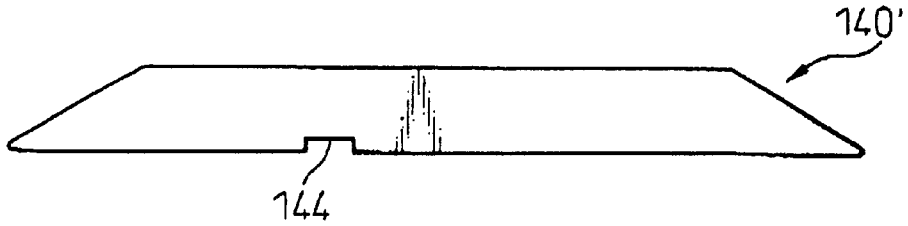
FIG. 28A is a side view showing a modified key top having one identifying element.
Figure 28B:
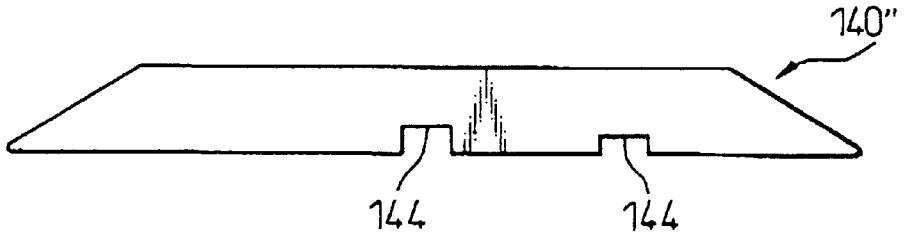
FIG. 28B is a side view showing another modified key top having two identifying elements with different depths.
Figure 29:
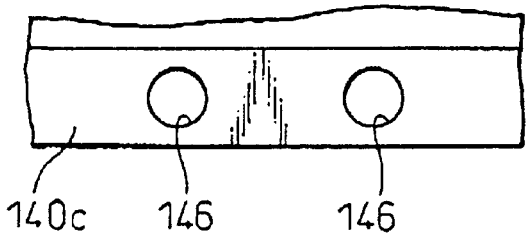
FIG. 29 is an enlarged partial bottom view showing a further modified key top.

FIGS. 26 and 27 show a key top 140 adapted to be incorporated in a key switch according to a fourth embodiment of the present invention. The key switch of this embodiment may have a structure substantially identical to that of any one of the key switches 10, 70, 100, except for the structure of the key top 140. Also, the key top 140 may applied to any conventional key switches, such as a key switch including a telescopic guide member, instead of a pair of link members, for supporting a key top above a base and directing or guiding the key top in a vertical direction.

The key top 140 is a dish-like member having a generally rectangular profile, and has an operating surface 140*a* adapted to be pressed by an operator's finger. The key top 140 is provided, on an inner surface 140*b* thereof opposite to the operating surface 140*a*, with two pairs of pivot supports 142, one pair being spaced from the other pair in the link-slide direction (i.e., leftward and rightward directions in FIG. 26), in a manner similar to the key top 14 shown in FIG. 3. The pivot supports 142 may be pivotably engaged with engagable regions of a pair of link members (not shown).

The key top 140 is also provided with an annular brim surface 140*c* extending adjacent to the operating surface 140*a* around the inner surface 140*b*, and an identifying portion 144 provided on the brim surface 140*c* for enabling the identification of the type or attribute of the key top 140. In the illustrated embodiment, the identifying portion 144 is formed as a plurality of identifying elements or recesses 144, each having a rectangular profile.

The identifying portion 144 of the key top 140 serves as an index for indicating various attributes of the key top 140, such as a color, a shape, a material, and so on. As shown in FIGS. 27; 28A and 28B, the key tops 140, 140' and 140" having different attributes may be provided with particular identifying portions 144 with different features, such as the number, the location or the depth of the recesses, optionally selected in accordance with the attributes of the key tops. In this arrangement, it is possible to precisely identify the attributes of the key tops 140, 140', 140" by checking one-by-one the features of the identifying portions 144 thereof, even if a large number of key tops 140, 140', 140" are mixed in a storage and/or a supply stage. The feature of the identifying portion 144 may be visually checked, or may be checked by known methods, such as pattern recognition by a charge-coupled device (CCD) or by ultrasonic depth discrimination.

According to the key switch including the key top 140 as described, it is possible to precisely and relatively easily identify the attributes, such as a color, a shape or a material, of a large number of key tops 140, in any stage, such as a stage of dividing of plural molded key tops into groups, or a stage of assembling of the key tops extracted from the divided groups, even if the various types of key tops made of different materials suitable for different printing steps such as a laser printing, a pad printing, and so on, should be stored and managed. Accordingly, the productivity of the key switch as well as of a keyboard incorporating therein a plurality of key switches can be significantly improved.

The identifying portion 144 of the key top 140 may be embodied as recesses, indentations, bumps or any other elements having various shapes and dimensions, such as a polygon, a circle or an oval. In any cases, the desired identifying portion 144 is preferably formed at a location having no significant influence on the appearance and operability of the key top 140.

A keyboard, such as the keyboard 60 shown in FIG. 6, may be constituted by incorporating a plurality of key switches according to the fourth embodiment in arrays, each key switches having an above-described key top 140. The keyboard having such a constitution can improve the productivity thereof because a large number of key tops 140 made of different materials can be correctly and relatively easily identified.

While the invention has been particularly shown and described with reference to preferred embodiments thereof, it will be understood by those skilled in the art that various changes and modifications may be made without departing from the spirit and scope of the following claims.

What is claimed is:

1. A key switch comprising;

a base;

a key top arranged above said base;

a pair of link members interlocked to each other to support said key top above said base and direct said key top in a vertical direction, each of said link members including an engagable region engaged with said key top; and a switching mechanism capable of opening and closing an electric circuit in connection with a vertical movement of said key top;

wherein said base is provided with an inner peripheral surface defining an opening capable of receiving said pair of link members, and a protruding wall part provided on said inner peripheral surface to locally reduce a clearance defined between said inner peripheral surface and said engagable region of each of said link members when said link members are received in said opening.

2. The key switch of claim 1, wherein each of said link members is provided at said engagable region with an axle projecting outward, said axle being pivotably connected with said key top, and wherein said base is provided with a plurality of protruding wall parts on said inner peripheral surface, each of said protruding wall parts being positioned so as to oppositely and closely face said axle of each of said link members when said key top is located at a lowermost position of a key-entry stroke.

3. The key switch of claim 2, wherein each of said protruding wall parts has a cross-sectional shape smaller than that of said axle of associated one of said link members.

4. The key switch of claim 1, wherein said protruding wall part has a uniform height measured from said inner peripheral surface.

5. The key switch of claim 1, wherein said protruding wall part has a gradually increased height measured from said inner peripheral surface as seen in a direction away from said key top.

6. A keyboard comprising a plurality of key switches, each of said key switches being defined in claim 1.

7. A key switch comprising:

a key top arranged above said base provided with pivot supports and abutting plates arranged respectively adjacent to said pivot supports, wherein each of said link members is provided at said engagable region with an axle projection outward, said axle being pivotably connected with one of said pivot supports of said key top, and wherein said axle is provided with an end surface including an apex abutted to one of said abutting plates arranged adjacent to one of said pivot supports with which said axle is pivotably connected;

a pair of link members interlocked to each other to support said key top above said base and direct said key in a vertical direction, each of said link members including an engagable region engaged with one of said base and said key top; and a switching mechanism capable of opening and closing an electric circuit in connection with a vertical movement of said key top;

wherein each of said link members is locally abutted in said engagable region onto one of said base and said key top under an elastic restoring force generated relatively in each of said link members and said base or said key top with which said link member is engaged.

8. The key switch of claim 7, wherein said axle is abutted at said apex to one of said abutting plates under a certain pressure caused by an elastic restoring force generated relatively in one of said link members and an associated one of said abutting plates.

9. A keyboard comprising a plurality of key switches, each of said key switches being defined in claim 7.

10. A key switch comprising:

a base provided with slide supports, wherein each of said link members is provided at said engagable region with an axle projecting outward, said axle being slidably connected with one of said slide supports of said base, and wherein said axle is provided with an end surface including an apex abutted to one of said slide supports with which said axle is slidably connected;

a key top arranged above said base;

a pair of link members interlocked to each other to support said key top above said base and direct said key top in a vertical direction, each of said link members including an engagable region engaged with one of said base and said key top; and a switching mechanism capable of opening and closing an electric circuit in connection with a vertical movement of said key top;

wherein each of said link members is locally abutted in said engagable region onto one of said base and said key top under an elastic restoring force generated relatively in each of said link members and said base or said key top with which said link member is engaged.

11. A key switch comprising:

a base provided with slide supports, wherein each of said link members is provided at said engagable region with an axle projecting outward, said axle being slidably connected with one of said slide supports of said base, and wherein said axle is provided with an annular rib circumferentially extending along a part of an axial length of said axle, said annular rib being abutted to one of said slide supports with which said axle is slidably connected;

a key top arranged above said base;

a pair of link members interlocked to each other to support said key top above said base and direct said key top in a vertical direction, each of said link members including an engagable region engaged with one of said base and said key top; and a switching mechanism capable of opening and closing an electric circuit in connection with a vertical movement of said key top;

wherein each of said link members is locally abutted in said engagable region onto one of said base and said key top under an elastic restoring force generated relatively in each of said link members and said base or said key top with which said link member is engaged.

12. A key switch comprising:

a base;

a key top arranged above said base provided with pivot supports, wherein each of said link members is provided at said engagable region with an axle projecting outward, said axle being pivotably connected with one of said pivot supports of said key top, and wherein each of said link members is provided with a textured surface located around a proximal end of said axle, said textured surfaces being abutted to one of said pivot supports with which said axle is pivotably connected;

a pair of link members interlocked to each other to support said key top above said base and direct key top in a vertical direction, each of said link members including an engagable region with one of said base and said key top; and a switching mechanism capable of opening and closing an electric circuit in connection with a vertical movement of said key top;

wherein each of said like members is locally abutted in said engagable region onto one of said base and said key top under an elastic restoring force generated relatively in each of said link members and said base or said key top with which said link member is engaged.

13. A key switch comprising:

a base;

a key top arranged above said base provided with pivot supports, wherein each of said link members is provided at said engagable region with an axle projecting outward, said axle being pivotably connected with one of said pivot supports of said key top, and wherein each of said link members is provided with a protuberance located adjacent to a proximate end of said axle, said protuberance being abutted to one of said pivot supports with which said axle is pivotably connected;

a pair of link members interlocked to each other to support said key top above said base and direct said key top in a vertical direction, each of said link members including an engagable region engaged with one of said base and said key top; and a switching mechanism capable of opening and closing an electric circuit in connection with a vertical movement of said key top;

wherein each of said link members is locally abutted in said engagable region onto one of said base and said key top under an elastic restoring force generated relatively in each of said link members and said base or said key top with which said link member is engaged.

14. A key switch comprising:

a base;

a key top arranged above said base;

a pair of link members interlocked to each other to support said key top above said base and direct said key top in a vertical direction, each of said link members including an engagable region slidably engaged with one of said base and said key top;

a switching mechanism capable of opening and closing an electric circuit in connection with a vertical movement of said key top; and a buffering portion for gradually braking a sliding motion of said engagable region of each of said link members relative to one of said base and said key top caused in accordance with said vertical movement of said key top just before said key top reaches an uppermost position of a key-entry stroke.

15. The key switch of claim 14, wherein said buffering portion comprises a buffer plate extending from said base, said buffer plate being elastically deflected by one of said link members colliding with said buffer plate just before said key top reaches said uppermost position.

16. The key switch of claim 14, wherein said buffering portion comprises a slanted wall surface formed on said base to face said engagable region of one of said link members, said slanted wall surface exerting a contact pressure against one of said link members colliding with said slanted wall surface just before said key top reaches said uppermost position.

17. The key switch of claim 14, further comprising a sheet member arranged beneath said base, and wherein said buffering portion comprises a high-friction area formed on said sheet member, said high-friction area exerting a friction force against one of said link members running onto said high-friction area just before said key top reaches said uppermost position.

18. A keyboard comprising a plurality of key switches, each of said key switches being defined in claim 14.

19. A key switch comprising:

a key top having an operating surface for a key-entry operation and supported to be directed in a vertical direction above a base;

said key top being provided with an identifying portion for an identification of an attribute of said key top.

20. The key switch of claim 19, wherein said identifying portion comprises a plurality of elements having various features including at least one of numbers, locations, shapes and dimensions.

21. The key switch of claim 20, wherein said key top further includes a brim surface adjacent to said operating surface, and wherein said elements are formed as recesses on said brim surface.

22. A keyboard comprising a plurality of key switches, each of said key switches being defined in claim 20.

23. A key switch comprising:

a base;

a pair of link members interlocked to each other to support said key top above said base and direct said key top in a vertical direction, each of said link members including an engagable region engaged with said key top and provided at said engagable region with an axle projecting outward with a plurality of protruding wall parts on said inner peripheral surface, each of said protruding wall parts being positioned so as to oppositely and closely face said axle of each of said link members when said key top is located at a lowermost position of a key-entry stroke; and a switching mechanism capable of opening and closing an electric circuit in connection with a vertical movement of said key top;

wherein said base is provided with an inner peripheral surface defining an opening capable of receiving said pair of link members, and a protruding wall part provided on said inner peripheral surface to locally reduce a clearance defined between said inner peripheral surface and said engagable region of each of said link members when said members are received in said opening.

24. A key switch comprising:

a base;

a pair of link members interlocked to each other to support said key top above said base and direct said key top in a vertical direction, each of said link members including an engagable region engaged with said key top and provided at said engagable region with an axle projecting outward, said axle being pivotably connected with said key top, and wherein said base is provided with a plurality of protruding wall parts on said inner peripheral surface, each of said protruding wall parts being positioned so as to oppositely and closely face said axle of each of said link members when said key top is located at a lowermost position of a key-entry stroke and having a cross-sectional shape smaller than that of said axle of associated one of said link members; and a switching mechanism capable of opening and closing an electric circuit in connection with a vertical movement of said key top;

wherein said base is provided with an inner peripheral surface defining an opening capable or receiving said pair of link members, and a protruding wall part provided on said inner peripheral surface to locally reduce a clearance defined between said inner peripheral surface and said engagable region of each of said link members when said link members are received in said opening.

25. A key switch comprising:

a base;

a pair of link members interlocked to each other to support said key top above said base and direct said key top in a vertical direction, each of said link members including an engagable region engaged with said key top; and a switching mechanism capable of opening and closing an electric circuit in connection with a vertical movement of said key top;

wherein said base is provided with an inner peripheral surface defining an opening capable of receiving said pair of link members, and a protruding wall part provided on said inner peripheral surface to locally reduce a clearance defined between said inner peripheral surface and said engagable region of each of said link members when said link members are received in said opening and having a uniform height measured from said inner peripheral surface.

26. A key switch comprising:

a base;

a pair of link members interlocked to each other to support said key top above said base and direct said key top in a vertical direction, each of said link members including an engagable region engaged with said key top; and a switching mechanism capable of opening and closing an electric circuit in connection with a vertical movement of said key top;

wherein said base is provided with an inner peripheral surface defining an opening capable of receiving said pair of link members, and a protruding wall part provided on said inner peripheral surface to locally reduce a clearance defined between said inner peripheral surface and said engagable region of each of said link members when said link members are received in said opening and having a gradually increased height measured from said inner peripheral surface as seen in a direction away from said key top. .

* * * * *

UNITED STATES PATENT AND TRADEMARK OFFICE

CERTIFICATE OF CORRECTION

PATENT NO. : 6,376,789 B2
DATED : April 23, 2002
INVENTOR(S) : Junichi Maruyama et al.

It is certified that error appears in the above-identified patent and that said Letters Patent is hereby corrected as shown below:

Column 27,
Line 14, change "proximate" to -- proximal --.

Column 28,
Line 18, change "20" to -- 19 --.
Line 27, after "outward" insert -- , said axle being pivotably connected with said key top, and wherein said base is provided --.

Signed and Sealed this

Twenty-second Day of October, 2002

*Attest:*

*Attesting Officer*

JAMES E. ROGAN
*Director of the United States Patent and Trademark Office*